United States Patent [19]

Farrand

[11] Patent Number: 4,945,804

[45] Date of Patent: Aug. 7, 1990

[54] METHOD AND SYSTEM FOR TRANSCRIBING MUSICAL INFORMATION INCLUDING METHOD AND SYSTEM FOR ENTERING RHYTHMIC INFORMATION

[75] Inventor: Philip F. Farrand, Springfield, Mo.

[73] Assignee: Wenger Corporation, Owatonna, Minn.

[21] Appl. No.: 143,861

[22] Filed: Jan. 14, 1988

[51] Int. Cl.[5] ..... G10G 3/04

[52] U.S. Cl. ..... 84/462; 84/478; 84/484

[58] Field of Search ..... 84/462, 470 R, 477 R, 84/478, 484, 1.03, DIG. 12, 1.01, 1.28, DIG. 6, 609-614, 649-652; 333/14

[56] References Cited

U.S. PATENT DOCUMENTS

| | | | |
|---|---|---|---|
| 3,926,088 | 12/1975 | Davis et al. . | |
| 4,331,062 | 5/1982 | Rogers . | |
| 4,366,741 | 1/1983 | Titus . | |
| 4,392,409 | 7/1983 | Coad, Jr. et al. . | |
| 4,506,587 | 3/1985 | Tanaka . | |
| 4,526,078 | 7/1985 | Chadabe . | |
| 4,546,690 | 10/1985 | Tanaka et al. | 84/477 R |
| 4,700,604 | 10/1987 | Morikawa et al. . | |

FOREIGN PATENT DOCUMENTS

| | | | |
|---|---|---|---|
| 2064851 | 6/1981 | United Kingdom | 84/462 |

OTHER PUBLICATIONS

Hawlett, W. and Selfridge-Field, E., *Directory of Computer Assisted Research in Musicology,* Center for Computer Assisted Research in the Humanities, 1985, pp. 1-50.

Hewlett, W. and Selfridge-Field, E., *Directory of Computer Assisted Research in Musicology,* Center for Computer Assisted Research in the Humanities, 1986, pp. 1-74.

Hewlett, W. and Selfridge-Field, E., *Directory of Computer Assisted Research in Musicology,* Center for Computer Assisted Research in the Humanities, 1987, pp. 1-90.

Bloom, M., *Music Through MIDI,* 1987, pp. 69-121, 143-174, 243-262.

Helmers, C. T., "Experiments with Score Input From A Digitizer", *Personal Computer Digest,* National Computer Conference, Personal Computing Festival, 1980, pp. 135-138.

Pfister, H. L., "Developing A Personal Computer Music System," *Personal Computing Digest,* National Computer Conference, Personal Computing Festival, 1980, pp. 119-124.

Shore, M. and McClain, L., "Computers Rock the Music Business", *Popular Computing,* Jun. 1983, pp. 96-102.

Talbot, A. D., "Finished Musical Scores from Keyboard: An Expansion of the Composer's Creativity", Proceedings of the ACM 1983 Conference: *Computers: Extending the Human Resource,* 1983, pp. 234-239.

*ConcertWare+ User'Manual,* 1985, pp. 1-15.

*Deluxe Music Construction Set User's Manual,* 1986, pp. 1.1-1.11, 2.18-2.32 and 3.1-3.3.

*Music Studio User's Manual,* 1985, pp. 1-17.

*Music Type* 2.0 *User's Manual,* 1984, pp. 1-18.

*Personal Composer User's Manual,* 1985, pp. 1-62, 73-77.

*PolyWriter User's Manual,* 1984, pp. 1-25.

*Professional Composer User's Manual,* 1985, pp. 1-93.

*SongWright User's Manual,* 1985; and *Encore Edit and Record Enhancement to SongWright,* 1986.

*The Music Shop—MIDI User's Manual,* 1985, pp. 1-42.

*Primary Examiner*—Stanley J. Witkowski

*Attorney, Agent, or Firm*—Dorsey & Whitney

[57] ABSTRACT

A method and system for transcribing musical information that allows a musician or composer to enter both rhythmic and melodic information directly from a musical instrument, such that the rhythmic information may be entered simultaneously with the entry of melodic information, during a subsequent pass after the entry of melodic information, or automatically either during or after the entry of melodic information using a companded approximation of a single unit of rhythmic information. Rhythmic information is entered as absolute and relative beat unit values from which relative note values (i.e. quarter note, half note) are assigned to the melodic information to create the proper graphic symbols to transcribe the musical information into musical notation or sheet music.

14 Claims, 22 Drawing Sheets

10
16
18
14
24
12
22
20

```
IN 1 0 0 .8
2 200 1
SU/TR/T99 1/PA3:A4:C:E/GS3/F5/E/D/C/B/A//GS/A//B/C/D/E//M/
F/E/D/C/B//A/GS/A/GS/FS/E/DN/FN/E/D/C/D/B/M;
Q/32///64//S///E/S/40X5/S/S./32/S/32//E/
32//S/E/S//S./32X4/64/;
TR 7 25 28;
2B;
3 8/11 +12/13 18/22 23/24 +25/29 30/32 37
```

MUSIC AS PLAYED

MUSIC AS TRANSCRIBED

MUSIC AS PLAYED

MUSIC AS TRANSCRIBED

MUSIC AS PLAYED

MUSIC AS TRANSCRIBED

Bach 2-Part Invention in C Major

METHOD AND SYSTEM FOR TRANSCRIBING MUSICAL INFORMATION INCLUDING METHOD AND SYSTEM FOR ENTERING RHYTHMIC INFORMATION

TECHNICAL FIELD

The present invention relates generally to the field of music publishing systems and methods of musical transcription and notation, and, more particularly, the present invention relates to a method and system for transcribing musical information that allows a musician or composer to enter rhythmic information for the musical information to be transcribed, such that the rhythmic information may be entered simultaneously with the entry of melodic information, during a subsequent pass after the entry of melodic information, or automatically entered by the system based upon a companded (compressed and expanded) approximation of the rhythmic information.

BACKGROUND ART

The language of music or musical notation has existed for more than eight centuries, but until the advent of the printing press musicians and composers were required to perform the time consuming taks of manual notation in order to memorialize their compositions. Even with the printing press, music publishing has always been a post composition process usually performed by someone other than the composer or musician. With the introduction of computers, special programming languages were developed for large mainframe computers and later mini computers to handle the entry and printing of musical notation. These languages used a textually based user interface that required the user to manually enter lengthy sets of computer codes in order to generate a single page of musical notation. In recent years, programs have been developed for personal computers in an effort to aid the musician and composer in musical notation. However, most of these programs still require the user to enter the music to be transcribed in some form of textually based language.

In the last seven years, the evolution of synthesizers and other electronic musical instruments led to the adoption of an international standard for the electronic representation of musical information, the Musical Instrument Digital Interface or MIDI standard. The MIDI standard allows electronic instruments, synthesizers and computers from different manufactures to communicate with one another through a serial digital interface. A good background and overview of the MIDI standard is provided in Boom, *Music Through MIDI,* 1987 (Microsoft Press), which is incorporated herein by reference. A few software programs have attempted to take musical data recorded as MIDI messages and turn it into standard musical notation or sheet music. Most of these programs are designed for use by the hobbyist composer and cannot properly transcribe more complex musical notations. While some of these programs have the advantage of allowing the musician or composer to enter melodic information on an instrument (generally pitch or not values and real time not and rest duration values), they require the use of some type of an external metronome to enter rhythmic information associated with the musical information and relative note durations (e.g. whole note, half note) based on the preset metronome information. This requirement imposes an arbitrary limitation on the composer or musician's ability to play a composition and have it correctly transcribed because all of the melodic information must be properly entered at a single preset rate. In addition, while these programs can assign relative not duration values to the musical data by reference to the external metronome, there is no ability to enter any beat unit information for the muscial data. The lack of beat unit information prevents these programs from correctly transcribing the musical data entered. Consequently, additional editing and manipulation must be performed by the user after the musical data has been entered.

Although the various systems and programs currently available have enabled music publishers to produce higher quality printed music or enabled hobbyists to enter and print simplistic musical notation, none of these systems has enabled the musician and composer to easily and accurately transcribe musical notation from ideas to paper by directly entering all of the musical information into a computer through an instrument played by the musician. Accordingly, there is a continuing need for the development of new tools to assit the musician and composer in the transcription of musical information by providing a method and system that will allow for the entry of rhythmic information thereby enabling the musician and composer to more easily and accurately transcribe musical data as it is played.

SUMMARY OF THE INVENTION

In accordance with the present invention a method and system for entering musical information to be transcribed is provided including an instrument for playing or entering rhythmic and melodic information associated with the musical information to be transcribed, an interface for translating this information into music data to be communicated to a processing means, and a programmable data processing means for receiving the music data and transcribing the music data into visual or printed musical notation.

Three distinct methods for entering rhythmic information are contemplated by the present invention: (1) the simultaneous entry of rhythmic information along with the entry of melodic information; (2) the subsequent entry of rhythmic information after the melodic information has already been entered into the system; and (3) the automatic entry of rhythmic information by the system using a companded approximation of what the rhythmic information should most likely be, based upon the entry of just two time markers. In general, the first method of entry will allow a musician or composer to designate a particular element on an instrument, for instance the soft pedal on an electronic keyboard, as a rhythm indicator so that the musician or composer need only tap out the meter or beat units on the soft pedal while playing the melody and accompaniment on the keyboard in order to provide the system with both the rhythmic and melodic information necessary to transcribe the music that was played into standard musical notation. The second method of entry allows the musician or composer to first enter the melodic information associated with a given piece of music and then enter the rhythmic information associated with the same piece of music by selecting a rhythm indicator, for instance either a key on the electronic keyboard or a key on the computer keyboard, and tapping in the meter or beat units of each measure as the system plays back the piece of music. Both of these methods of entry give the composer or musician control over the rate of entry of music data by allowing the musician or composer to control the rate of the meter or beat units for the music data being entered. In other words, the present invention allows a musician or composer to set his or her own rate of entry, even including stopping for a moment to think about how best to play the next measure of the composition before entering it. The third method of entry allows the musician or composer to enter the melodic information associated with a given piece of music without having to enter any rhythmic information other than entering a pair of time markers to define the duration of the starting beat unit of the musical information to be transcribed. Normally changes in the tempo of a given piece of music will occur gradually and in a predicatble manner. The third method uses this gradually and in a predictable manner. The third method uses this starting beat unit to approximate what the remaining beat units would be for the entire piece of music either by compressing or shortening the beat unit or by expanding or lengthening the beat unit until the tempo matches up with the melodic information as played. This type of compression/expansion approximation is sometimes referred to as companding.

A music transcription system according to the present invention may be realized by a wide variety of combinations of particular hardware ans software components so long as the system includes an instrument capable of playing melodic information, a means for entering rhythmic information, an interface that translates this information into a format that can be recognized by a programmable data processing means, and a programmable data processing means or computer capable of storing and running a software program. The software program may be comprised of various modules that capture the music data, filter and quantize the aboslute note duration information contained in the music data; assign relative note duration values to the filtered music data by comparing the melodic and rhythmic information contained in the music data; and perform various graphical interpretations of the music data base upon the melodic and rhythmic information and additiona information contained in the music data.

Accordingly, a primary objective of the present invention is to provide a method and system for transcribing musical information that allows a musician or composer to enter both melodic and rhythmic information simultaneously by playing a musical instrument.

Another objective of the present invention is to provide a method and system for transcribing musical information that allows a musician or composer to first enter melodic information by playing a musical instrument and then add rhythmic information during a subsequent playback pass.

Another objective of the present invention is to provide a method and system for transcribing musical information that allows a musician or composer to enter the melodic information and a pair of time markers that will define the starting beat unit and let the system approximate the remaining rhythmic information.

A further objective of the present invention is to provide a music transcription system that will more easily and accurately transcribe musical notation by accepting input of melodic and rhythmic information directly from a MIDI instrument without requiring either that the music be played to a preset metronome or that additional rhythmic information be entered in a textual format after the entry of the melodic information.

These and other objectives of the present invention will become apparent with reference to the drawings, the description of the preferred embodiment and the appended claims.

DESCRIPTION OF THE PREFERRED EMBODIMENT

Figure 1:
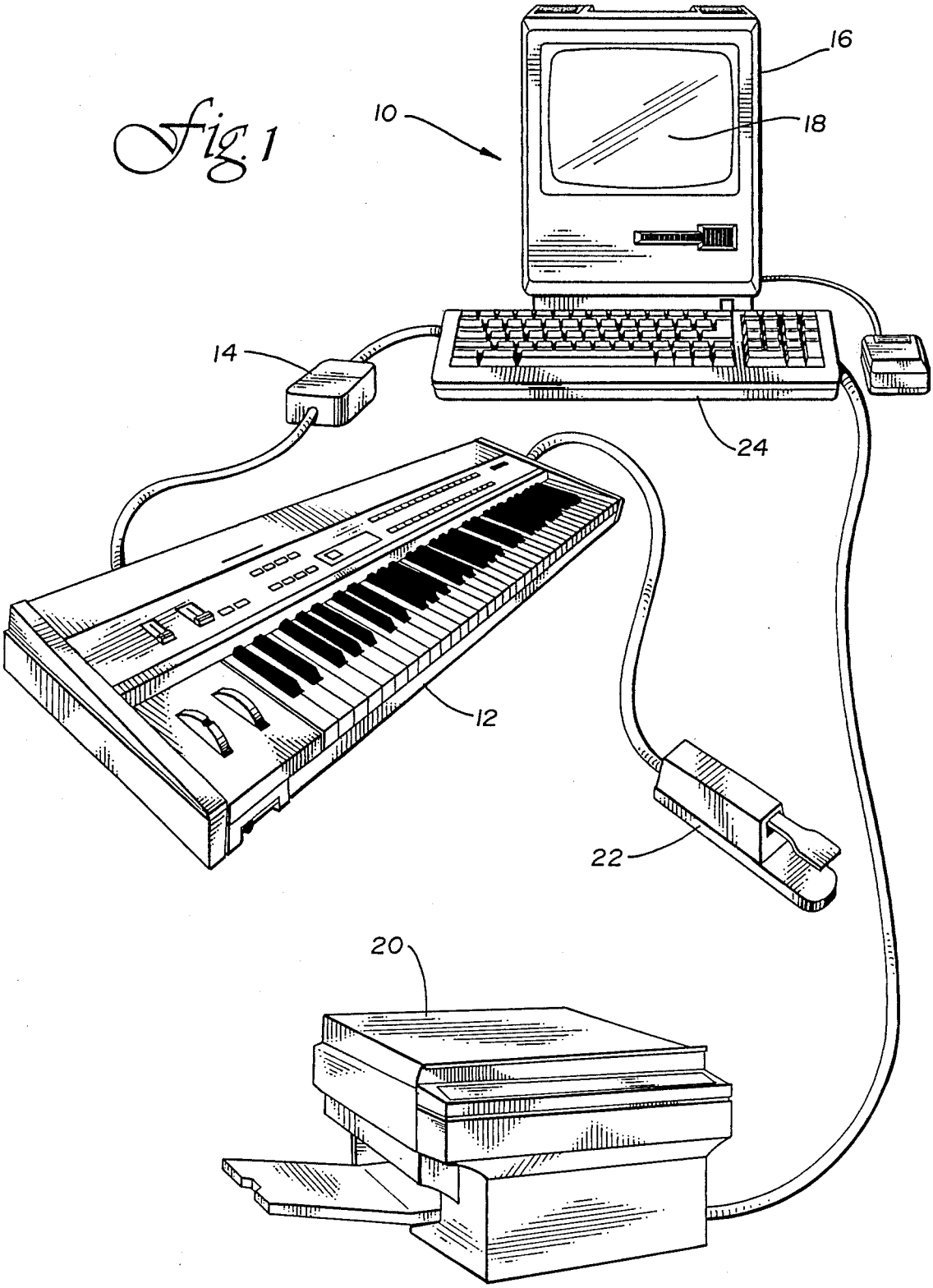
FIG. 1 is diagram of a system in accordance with the present invention including an electronic keyboard, a MIDI interface, and a programmable data processing means.

To understand the nature an scope of the present invention, it is first necessary to understand the nature and relationship of the melodic and rhythmic information components of music as will be used to describe the invention. Melodic information refers primarily to both the pitch and absolute duration of the individual notes entered by the musician or composer. Pitch refers to the tonal properties of a sound that are determined by the frequency of the sound waves that produce the individual note. In classical western musical notation, pitch is denoted with reference to a series of half-step intervals that are arranged together in octaves, each octave comprising 12 half-steps or notes. For purpose of defining melodic information as used in this invention, note duration is the length of time a particular note is played. Note duration is sometimes thought of as the relative time value of a given note, i.e. whole note, half note, quarter note, eighth note, etc. For purposes of this invention, however, note duration in terms of melodic information refers only to the absolute time value of a given note, i.e. absolute note duration. It is necessary to distinguish between relative and absolute time value of a note because relative time value can only be correctly resolved when the proprer beat unit is known, i.e. a half not played at 160 beats per minute should be notated differently than a quarter note played at 80 beats per minute, even though both notes will have the same absolute time value.

Rhythmic information, on the other hand, refers to everything pertaining to the time aspects of music as distinct from the melodic aspects. It includes the effects of beats, accents, measures, grouping notes into beats, grouping of beats into measures and grouping of measures into phrases. For purposes of the present invention, four distinct components comprise the rhythmic information necessary to easily and accurately transcribe music into musical notation: (1) relative note duration-this is the length of time a note is played in terms of the time signature for the measure; i.e. half note, quarter note; (2) beat unit—the base unit of time used to measure the tempo of a piece of music; (3) measure—the organization of beat units into groups corresponding to the time signature of the composition or section of a composition; and (4) accent—the designation of particular emphasized beat units or notes within a measure. The function and importance of rhythmic information or the "beat" relates to the fact that the human ear seems to demand the perceptible presence of a unit of time that can be felt as grouping the individual notes together. In classical western notation, the beat unit and the relation between beat units and measures are designated by the tempo marking, e.g. 120 beats per minute, and the time signature, e.g. 3/4, where the top number indicates the number of beat units per measure (in this case 3) and the bottom number designates the type of note that the beat units will be measured in, e.g. the note value that will receive one beat unit (in this case a quarter note). Though sometimes referred to as the beat, for purposes of this invention, an accent will define which notes, beat unit(s), or sub-divisions of beat units in a measure or group of measures are to receive accentuation or emphasis.

It is also helpful in understanding the invention to know how musical information, both melodic and rhythmic information, can be represented electronically. Though by no means the only method of representing music information (music data), the MIDI standard has become the preferred method for communicating music data between different electronic devices. For purposes of the present invention, it is sufficient to understand that music data is serially communicated between devices in a MIDI environment either by a system message or a channel message, each of which are comprised of a status byte followed by a number of data bytes. The system messages are divided into real-time messages and common messages, with the timing clock message included in real time messages. The channel messages are divided into mode messages and voice messages, with the note on and note off messages included in voice messsages. For a more detailed explanation, reference is made to Boom, *Music Through MIDI*, Chapter 5, pp. 69–94. The relationship between timing clock messages and note on and note off messages will be described further below in connection with FIGS. 8*a* and 8*b*. While reference is made to the serial MIDI standard, it should be noted that any means of communicating the necessary melodic and rhythmic information would work with the present invention. For instance, the melodic and rhythmic information might be communicated over a parallel digital interface or might even be conveyed in terms of analog signals instead of digital bytes.

Referring now to FIG. 1 the overall functional relationship among the elements of the present invention can be seen. In a preferred embodiment of the present invention, the music transcription system 10 is composed of an electronic keyboard 12, a MIDI interface 14, and a programmable data processing means 16. While an electronic keyboard 12, in this case a DX-7 synthesizer available from Yamaha International Corporation, P.O. Box 6600, Buena Park, Calif. 90622, is shown, it will be seen that any instrument equipped with a MIDI converter would be capable of providing the necessary melodic and rhythmic information to the system. The preferred programmable data processing means 16 of the present invention is a programmable digital microcomputer capable of receiving the melodic and rhythmic information from the music data and transcribing the music data to output it as musical notation, either visually on a computer screeen 18 or in printed format by an attached printer 20. It should also be noted that microcomputer 16 may include MIDI interface 14 within the components included in the computer housing. In one preferred embodiment, microcomputer 16 is an Apple Macintosh SE computer available from Apple Computer, Inc., 20525 Mariani Avenue, Cupertion, Calif. 95014, equipped with an Apple MIDI interface unit and a Laser Writer printer also available from Apple Computer, Inc. The functioning of microcomputer 16 is controlled by means of control information in the form of a software program that functions in the manner described in connection with FIGS. 9–14, although those skilled in the art will recognize that various software functions can also be accomplished by equivalent hardware.

Figures 2A, 2B:
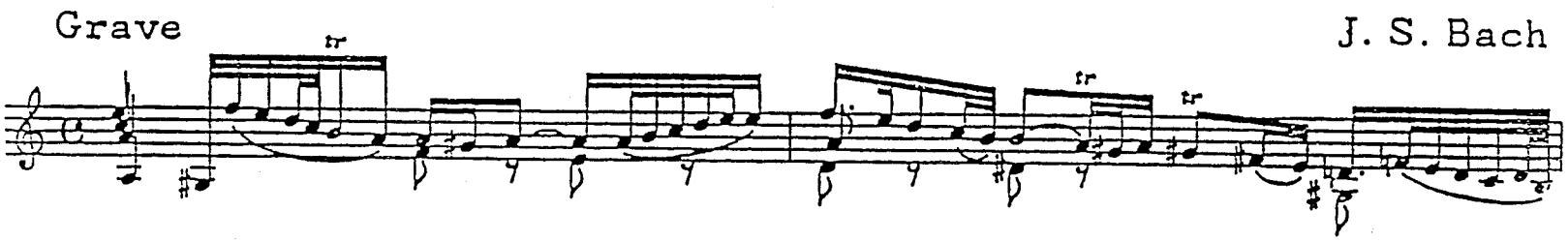
Fig. 2a PRIOR ART
Fig. 2b PRIOR ART
FIG. 2*a* is a sample input from an prior art textually based musical transcription program.
FIG. 2*b* is a sample transcription output or musical notation from a prior art textually based musical transcription program based on the input provided in FIG. 2*a*.

FIGS 2*a* and 2*b* demonstrate a typical prior art music notation program that uses a textually based input system to create musical notation. It will be seen in FIG. 2*a* that all of the information associated with the music to be transcribed is entered through a complicated textual language and that the duration of notes must be entered on a second pass. More recent programs of this type allow for the entry of melodic and rhythmic information by graphically clicking the desired note, i.e. half note, quarter note, on the desired staff location of a staff displayed on a computer screen. While aiding the musician or composer in the speed of input, these programs do not allow the musician or composer to actually play the composition on an instrument and, consequently, the musician or composer must learn a different and sometime ackward language in order to create musical notation. As shown in FIG. 2*b*, in addition to the obvious disadvantage associated with textual input, there are many deficiencies in the musical notation produced by this program, including, for example: chords and chord stems that are not properly aligned, irregular and incorrect beaming, and inconsistent or incorrect separation of voices. These deficiencies are inherent in these types of programs because of the inability to effectively and efficiently represent all of the melodic and rhythmic information necessary to properly transcribe a segment of music.

Figure 3:
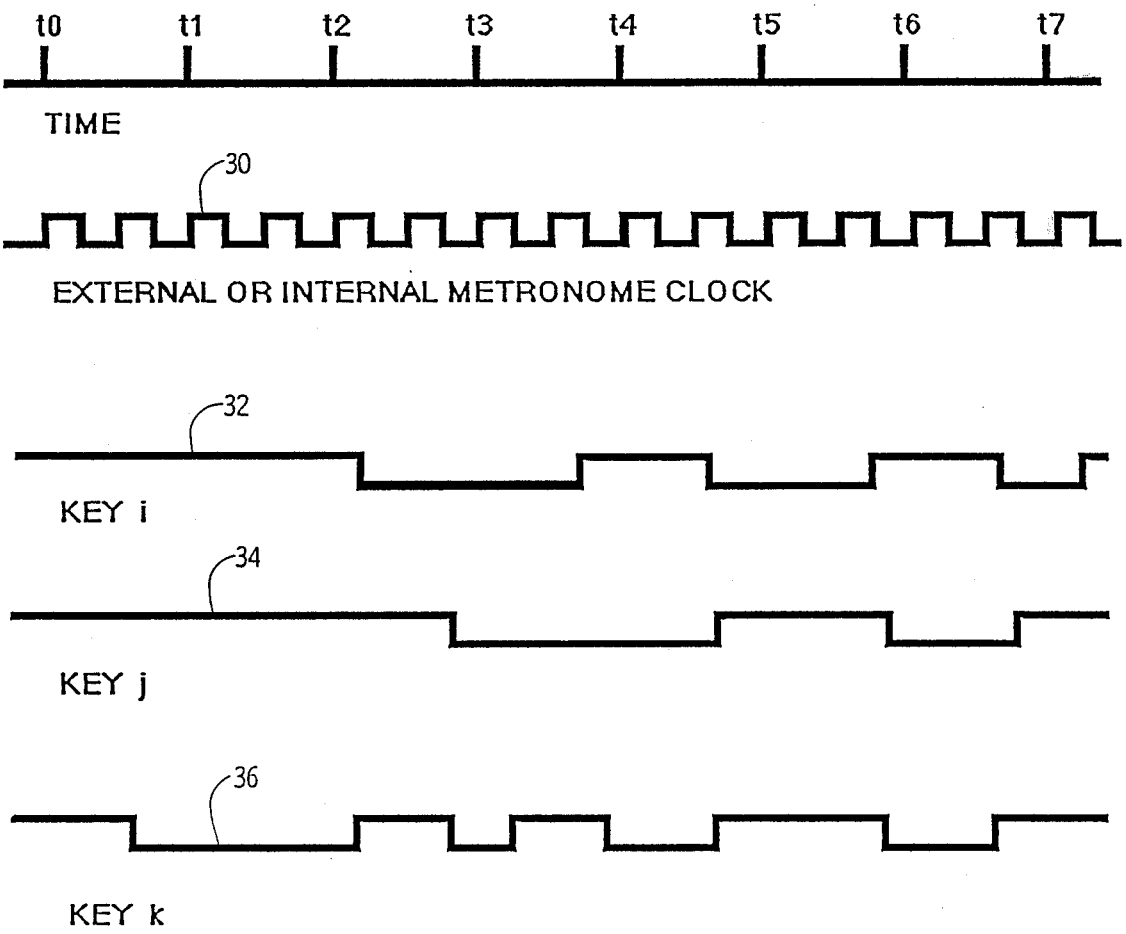
FIG. 3 is a sample timing diagram from a prior art metronome based musical transcription system.
Figure 4A:
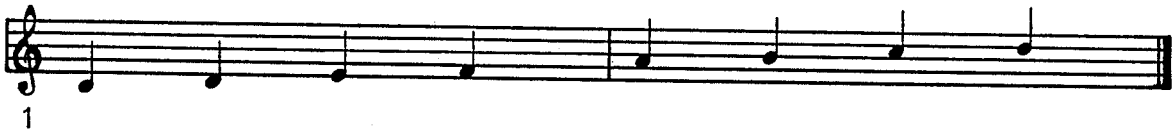
Fig. 4a PRIOR ART
FIGS. 4*a*–4*c* are a series of comparisons between sample transcription outputs or musical notations from a prior art metronome based musical transcription program and the music as it should have been transcribed.
Figure 4A:
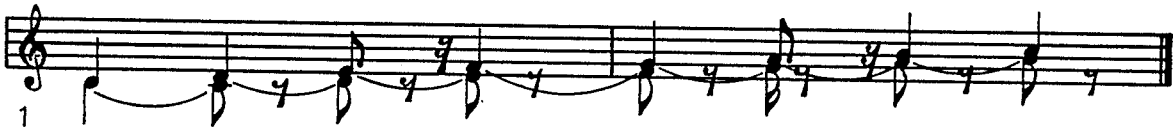
Fig. 4a PRIOR ART
Figure 4B:
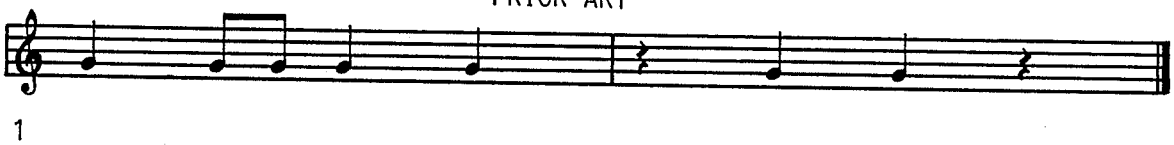
Fig. 4b PRIOR ART
Figure 4B:
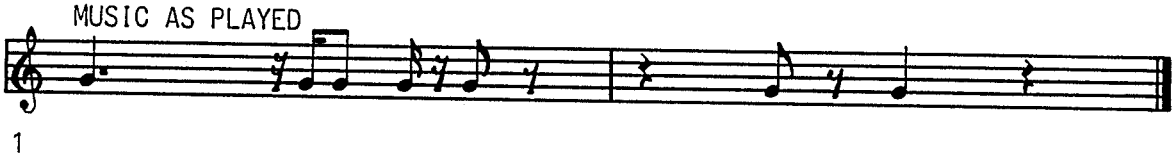
Fig. 4b PRIOR ART
Figure 4C:
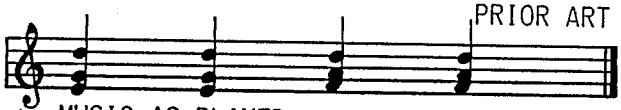
Fig. 4c PRIOR ART
Figure 4C:
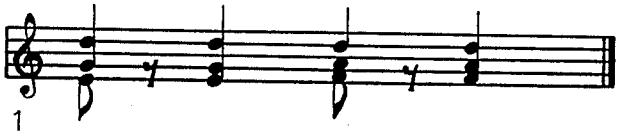
Fig. 4c PRIOR ART

FIG. 3 shows a timing diagram from a prior art music notation program that allows for entry of melodic information from an electronic keyboard with rhythmic information being assigned on the basis of a preset metronome value 30. Preset metronome value 30 dictates the tempo at which music data must be entered into the system. After an introductory two measures, the musician or composer must begin entering melodic information in the form of music data by playing keys 32, 34, and 36 on an electronic keyboard in time with preset metronome 30. In order for the program to accurately transcribe music data, the musician or composer must try to enter all of the notes accurately in relation to the metronome, i.e. the beat of the musician or composer's playing must be exactly synchronized with the beat dictated by preset metronome 30. The musician or composer must also pay close attention to articulation because the relative note duration, relative rest duration, quantization and grouping into measures are all dictated by the fixed and constant beat of the metronome. In addition to the perfection of entry demanded by such a program and the inability to change tempo or pause during the entry of music due to the preset metronome value, the use of the metronome affects the quality and accuracy of the music transcribed a shown in FIGS. 4*a*–4*c*. FIG. 4*a* shows how such a system might transcribe the entry of a typical scale if the musician or composer was not entering the music data exactly in synchronization with the preset metronome value. FIG. 4*b* shows how such a system might transcribe the entry of music data if the musician or composer was not articulating the notes correctly in relation to the preset metronome value. Finally, FIG. 4*c* shows how such a system might incorrectly transcribe the entry of chord information, improperly separating voices and misdrawing note stems.

The present invention overcomes the indaequacies in the prior art by giving the musician or composer control over the entry of the beat unit. In the present invention, the entry of the beat unit is accomplished by one of three distinct methods: In-Fix Transcription Method—the simultaneous entry of beat unit information along with the entry of melodic information, Post-Fix Transcription Method—the subsequent entry of beat unit information after the entry of melodic information, and Companding Transcription Method—the automatic entry of rhythmic information by the system using a companded approximation of what the rhythmic information would be based upon the entry of just two time markers.

In general, the In-Fix Transcription Method of entry or "Hyperscribe" method allows a musician or composer to designate a particular element on an instrument to be used as the beat unit indicator, for instance the soft pedal 22 on electronic keyboard 12. The musician may also enter or set the time signature(s) for the measure or measures to be transcribed, the default accent tables, and the particular stave system that the music data will be transcribed onto. To enter music data, the musician or composer need only tap out the beat units on soft pedal 22 while playing the melody on electronic keyboard 12.

The Post-Fix Transcription Method of entry allows the musician or composer to first enter the melodic information, time signature and, if desired, the stave system associated with a given piece of music. After this information is entered, the beat unit information associated with the same music is entered by selecting a beat unit indicator, for instance either soft pedal 22 on electronic keyboard 12 or a key on computer keyboard 24, and tapping in the beat units for each measure as system 10 plays back the piece of music or graphically displays the music data previously entered.

The Companding Transcription Method of entry allows the musician or composer to let system 10 determine the beat units by a best fit approximation of the rhythmic information based on the entry of a pair of time markers that define the duration of the starting beat unit. The system uses the starting beat information to perform a companded (compressed and expanded) approximation to determine the remaining beat units for the melodic information. The musician or composer may enter the pair of time markers that determine the value of the starting beat unit either before or after the melodic information is entered on electronic keyboard 12 and may use either a key on electronic keyboard 12, for instance soft pedal 22, or a key on computer keyboard 24 to enter the pair of time markers. Normally, a musician or composer will change the tempo of a given piece of music gradually and in a predictable manner as the musician of composer plays the given piece of music. In the Companding Transcription Method, system 10 utilizes this assumption to approximate what the remaining beat units would be based on the entry of a single pair of time marker thqt define the starting beat unit.

It should be noted that multiple staff or multiple track compositions or scores can be created using any of the transcription methods of this invention by designating a particular staff or system of staves for a given voice or instrument, entering the musical information for that voice or instrument, and then selecting a new staff or stave system for the next voice or instrument and entering different musical information for that voice or instrument, repeating this process as many times as necessary to enter the desired number of staves. In addition, though not necessary, a musician or composer could also have system 10 playback the piano melody during entry of the music data for another voice or instrument to assist the musician or composer in matching or coordinating voices and instruments notated on various staves.

Figure 5:
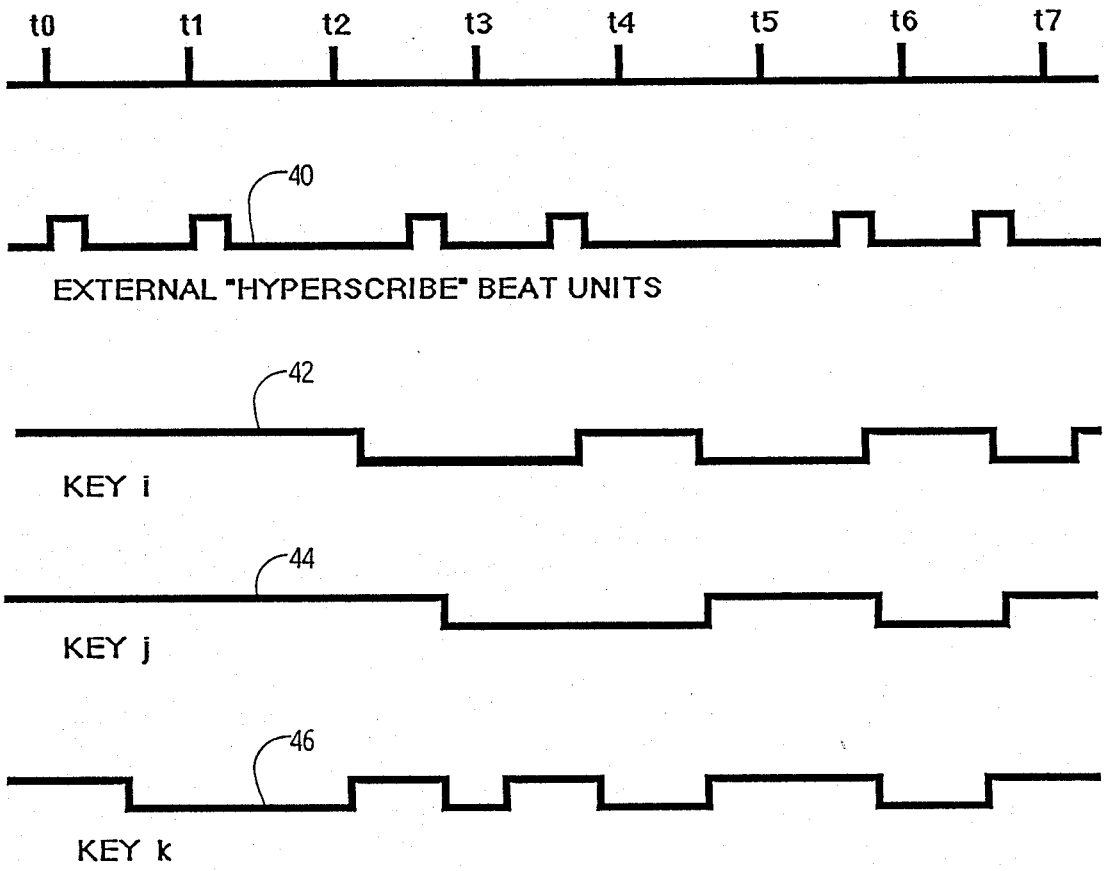
FIG. 5 is a sample timing diagram from the present invention.
Figure 6:
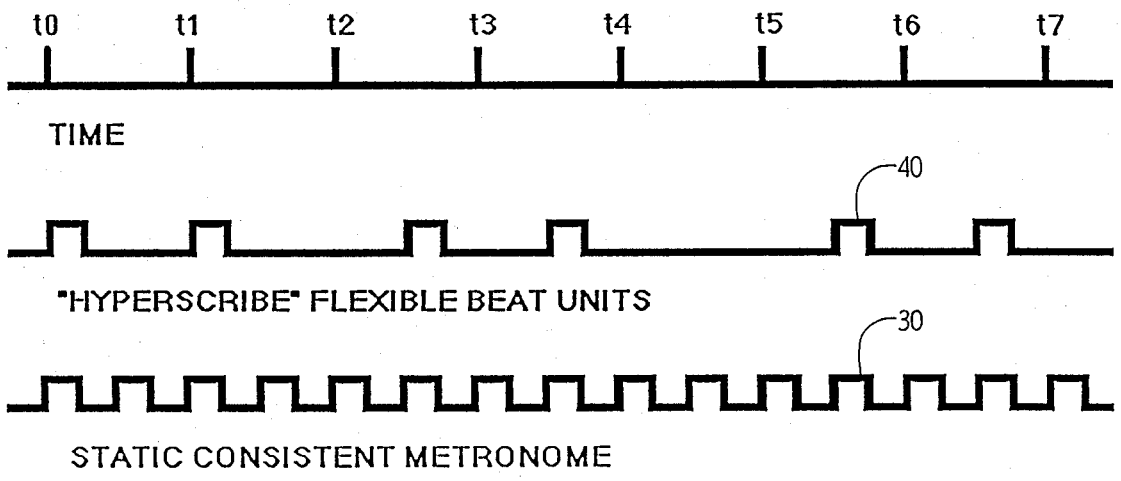
FIG. 6 is a comparison of the timing diagrams shown in FIG. 3 and FIG. 5.
Figure 7:
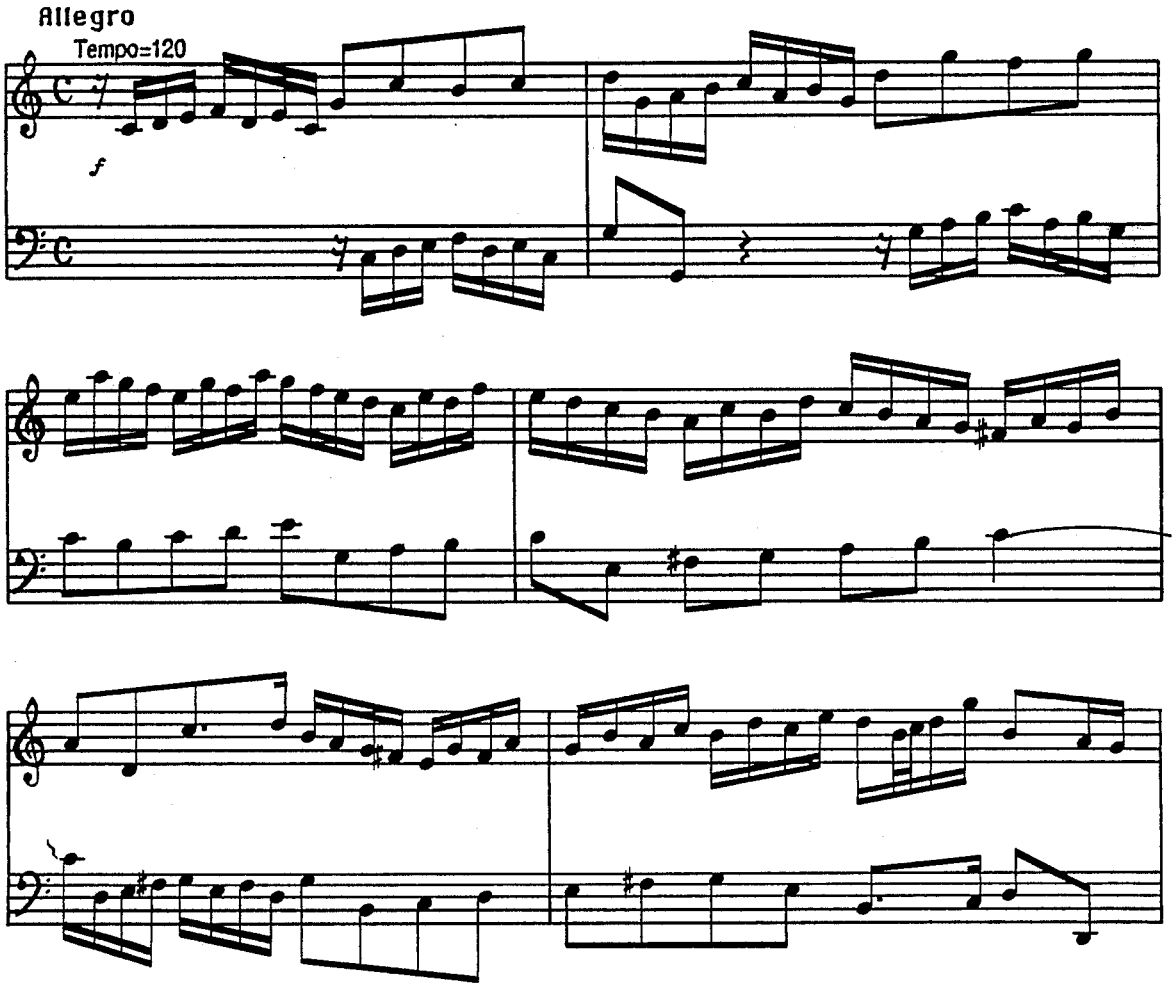
FIG. 7 is a sample unedited transcription output or musical notation created using the In-Fix Transcription Method of the present invention.

As shown in FIG. 5 the method and system of the present invention allows for the entry of beat units 40 in addition to the entry of melodic information 42. In FIG. 5, the In-Fix Trascription Method of entry is used and both melodic information as entered on keys 42, 44, and 46 and beat units 40 are entered simultaneously. FIG. 6 shows a comparison as a function of time between preset static metronome value 30 of the prior art program and beat units 40 as entered in accordance with the present invention. While only a measures worth of music data is shown in FIG. 6, it should be noted that a musician or composer could pause at any point during the entry of music data and beat units 40 during the In-Fix Transcription Method of the present invention without affecting the proper transcription of the musical information. Obviously, this allows the musician or composer complete flexibility and cntrol in entering the music data to be transcribed. This flexibility and control enables the creative element that is involved in the composition of a piece of music to occur naturally, thus enhancing the usefulness and usability of the transcription tool. It also enables system 10 to more accurately transcribe the music data as demonstrated by the results of the unedited transcription of Bach 2-Part Invention in C major as shown in FIG. 7 that was entered using the In-Fix Transcription Method of the present invention.

Figure 8A:
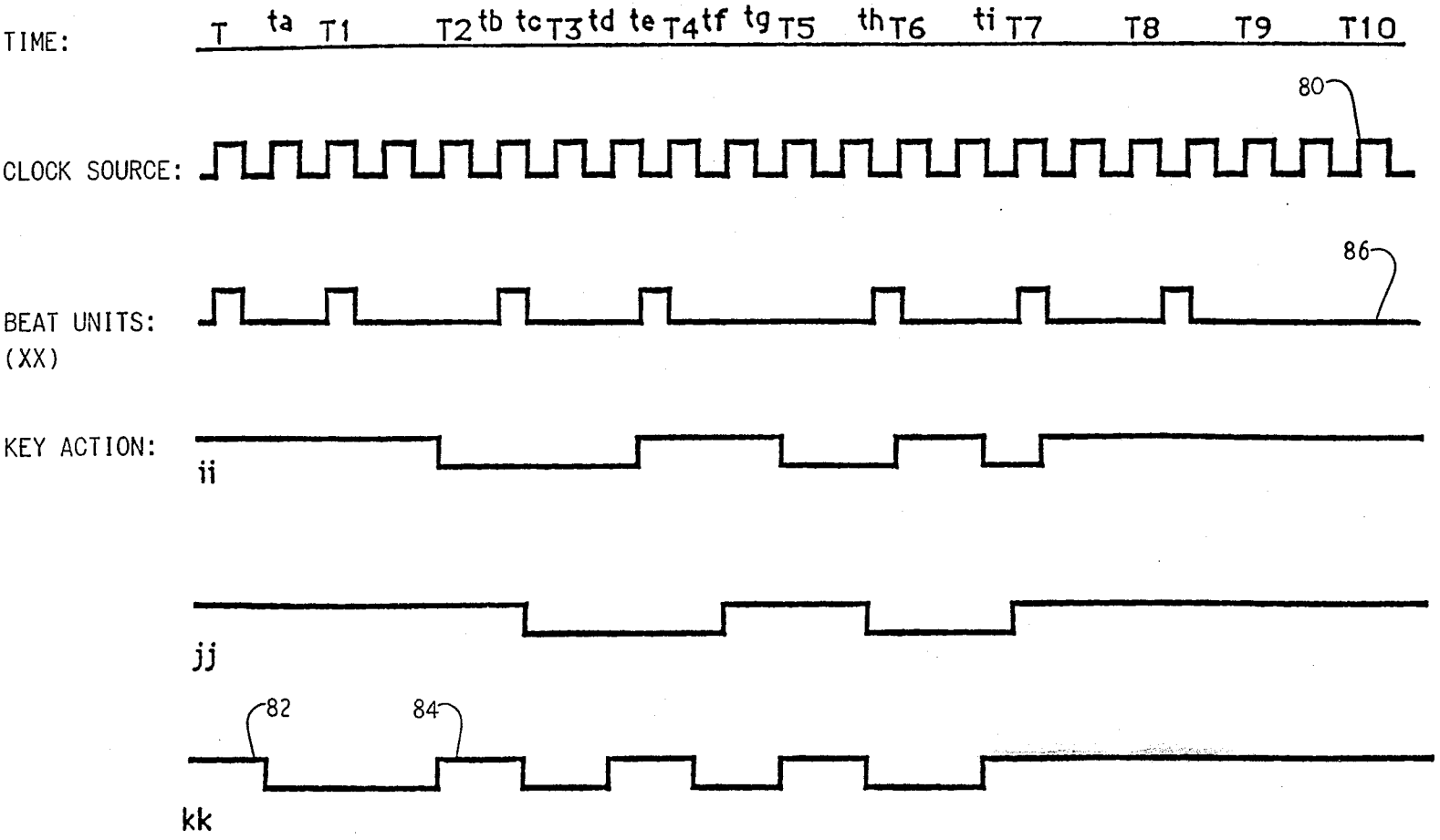
FIGS. 8*a* and 8*b* are a diagram of a sample timing diagram and corresponding MIDI music data input stream, respectively, created using the In-Fix Transcription Method of the present invention.
Figure 8B:
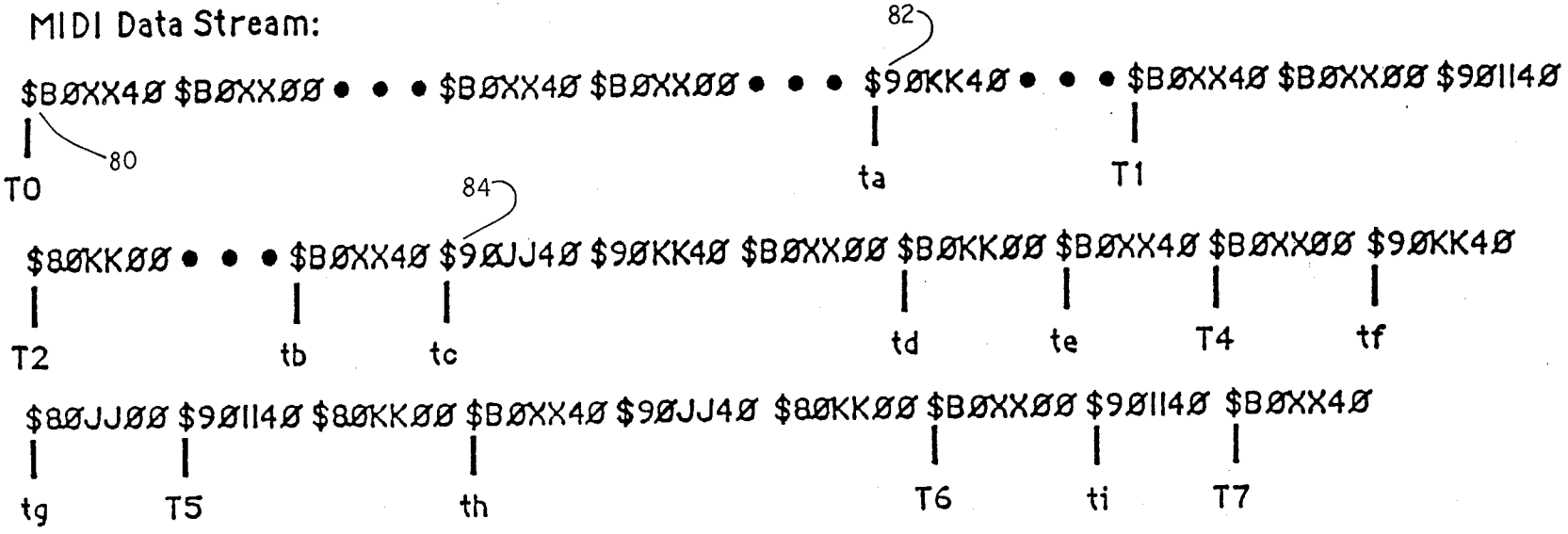

Referring now to FIGS. 8*a* and 8*b*, a sample MIDI music data stream generated by using the In-Fix Transcription Method or Hyperscribe method of entry is shown. The important control and data bytes in the MIDI data stream for purposes pf understanding the present invention are: (1) Timing Clock Byte 80, as shown for example at T0 in both the Clock Source trace in FIG. 8*a* and the MIDI Data Stream in FIG. 8*b*; (2) Key On Byte 82, as shown for example at ta in both the Key Action trace in FIG. 8*a* and the MIDI Data Stream in FIG. 8*b*; and (3) Key Off Byte 84, as shown for example at tc in both the Key Action trace in FIG. 8*a* and the MIDi Data Stream in FIG. 8*b*. The Key Action Traces ii, jj, and kk represent the key down and key up action as detected by the MIDI instrument, electronic keyboard 12 for instance. Beat Unit Bytes 86 represent beat units 40 in FIG. 5 as they would be represented by combinations of Key On Byte 82 and Key Off Byte 84 for the particular key or pedal that has been designated as the rhythm or beat unit indicator in the In-Fix Transcription Method.

Figure 9A:
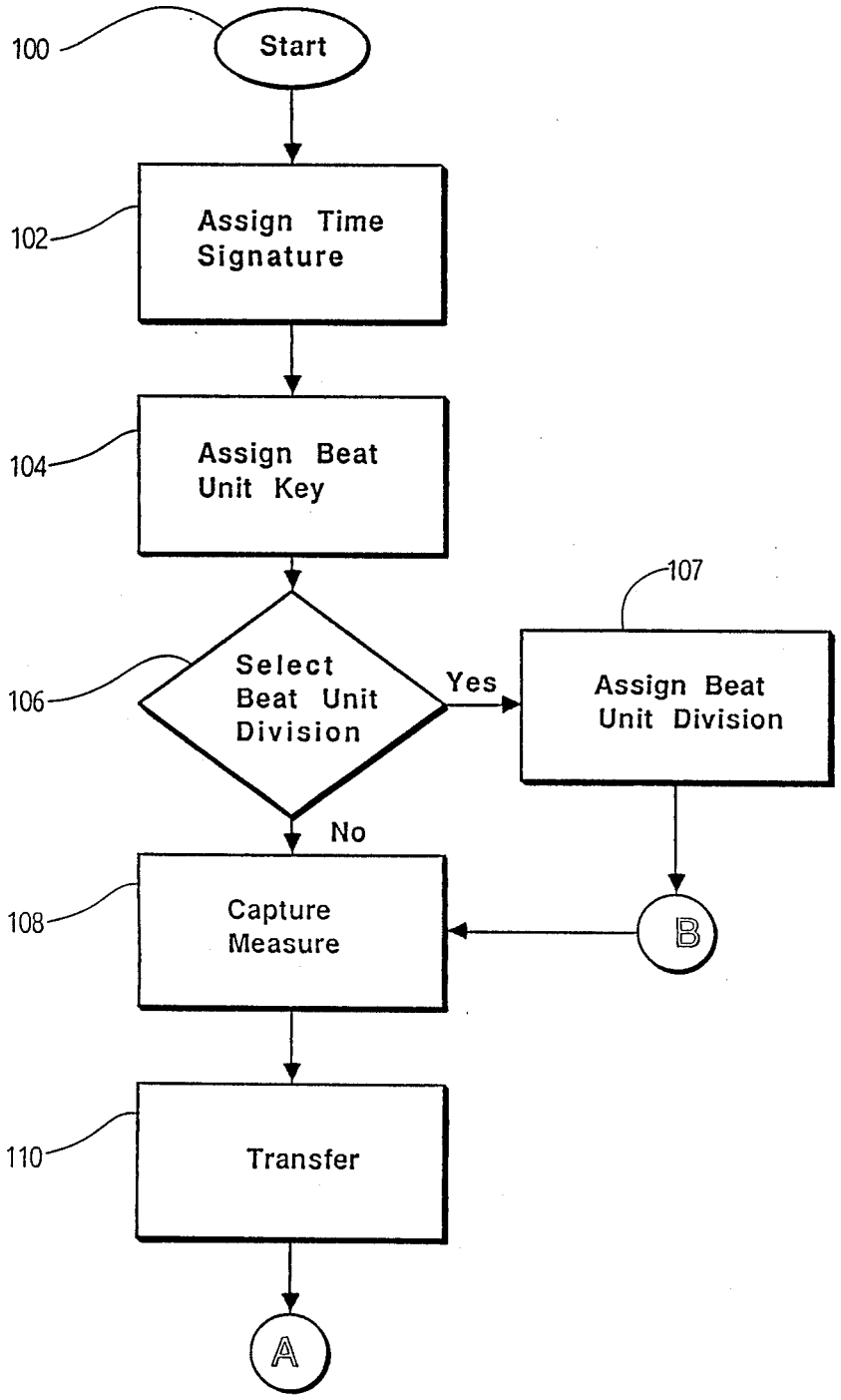
FIGS. 9*a*–9*b* are a flowchart diagram of the transcription method of the present invention when rhythmic information is entered simultaneously with the entry of melodic information, the In-Fix Transcription Method.
Figure 9B:
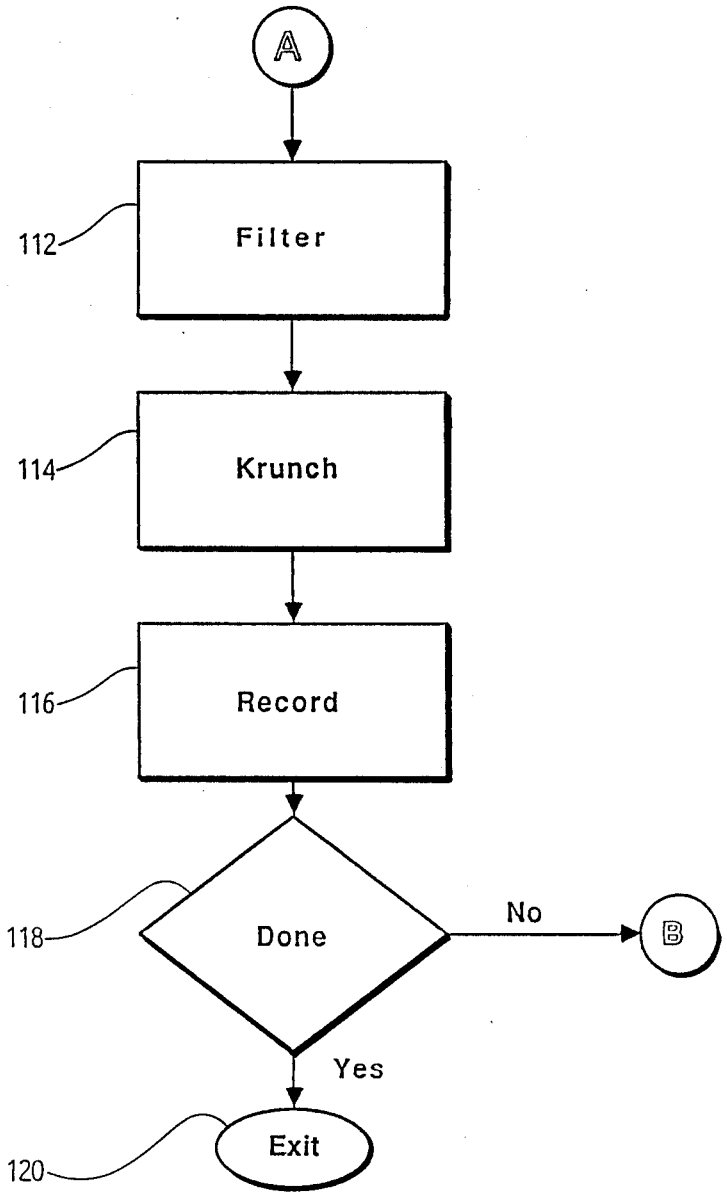
Figure 10A:
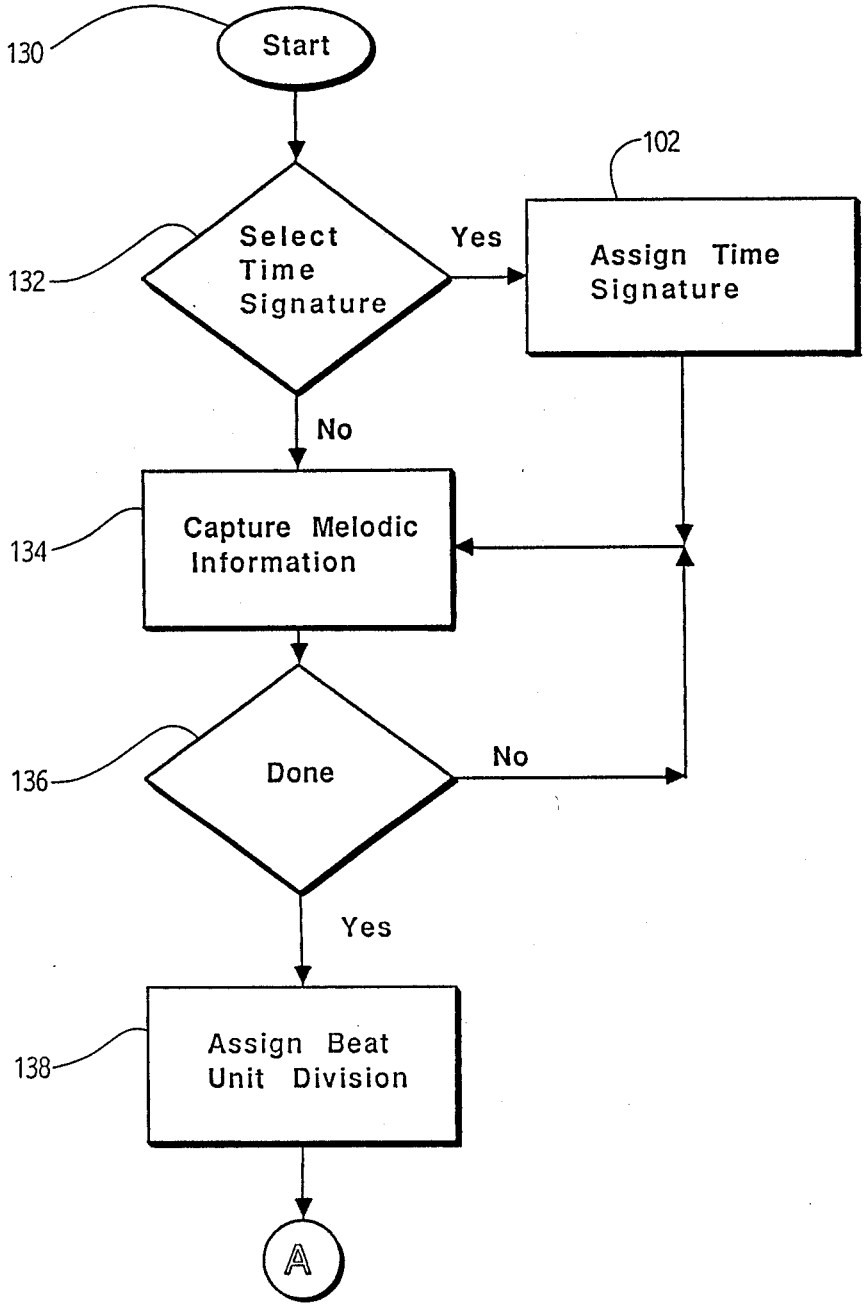
FIGS. 10*a*–10*d* are a flowchart diagram of the transcription method of the present invention when rhythmic information is entered subsequent to the entry of melodic information, the Post-Fix Transcription Method.
Figure 10B:
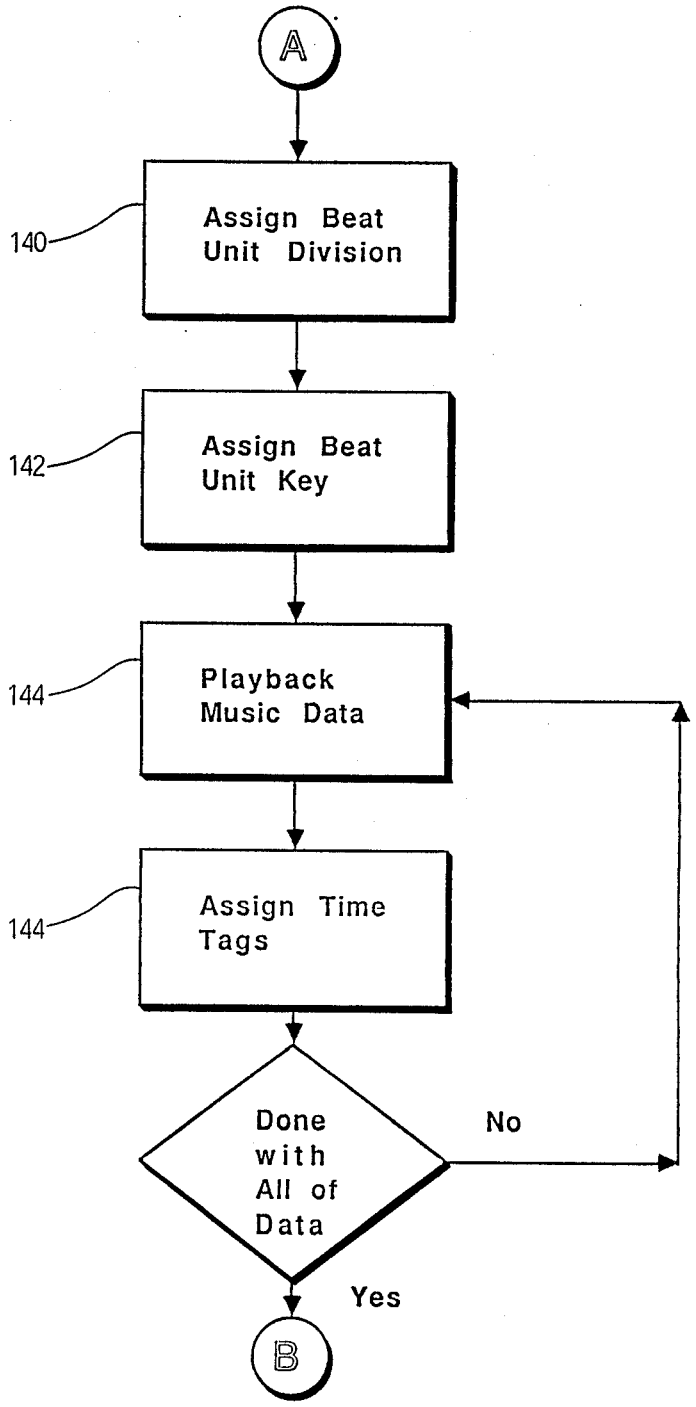
Figure 10C:
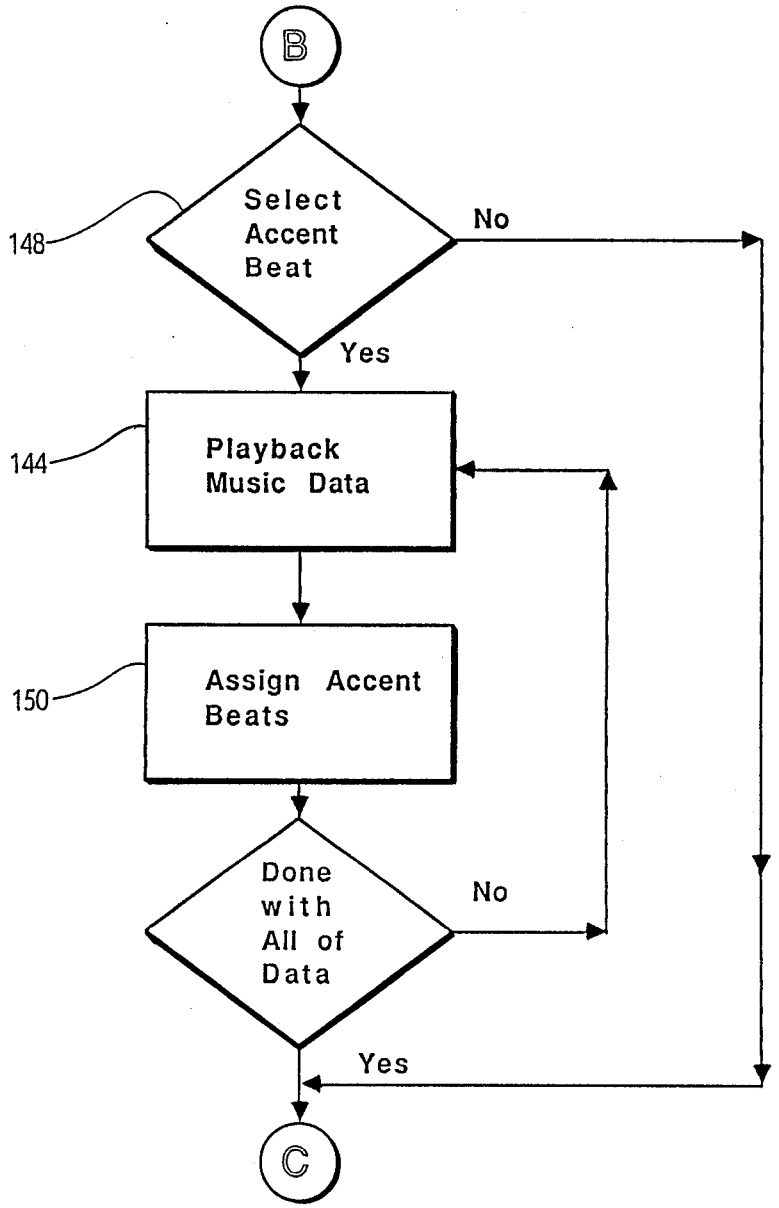
Figure 10D:
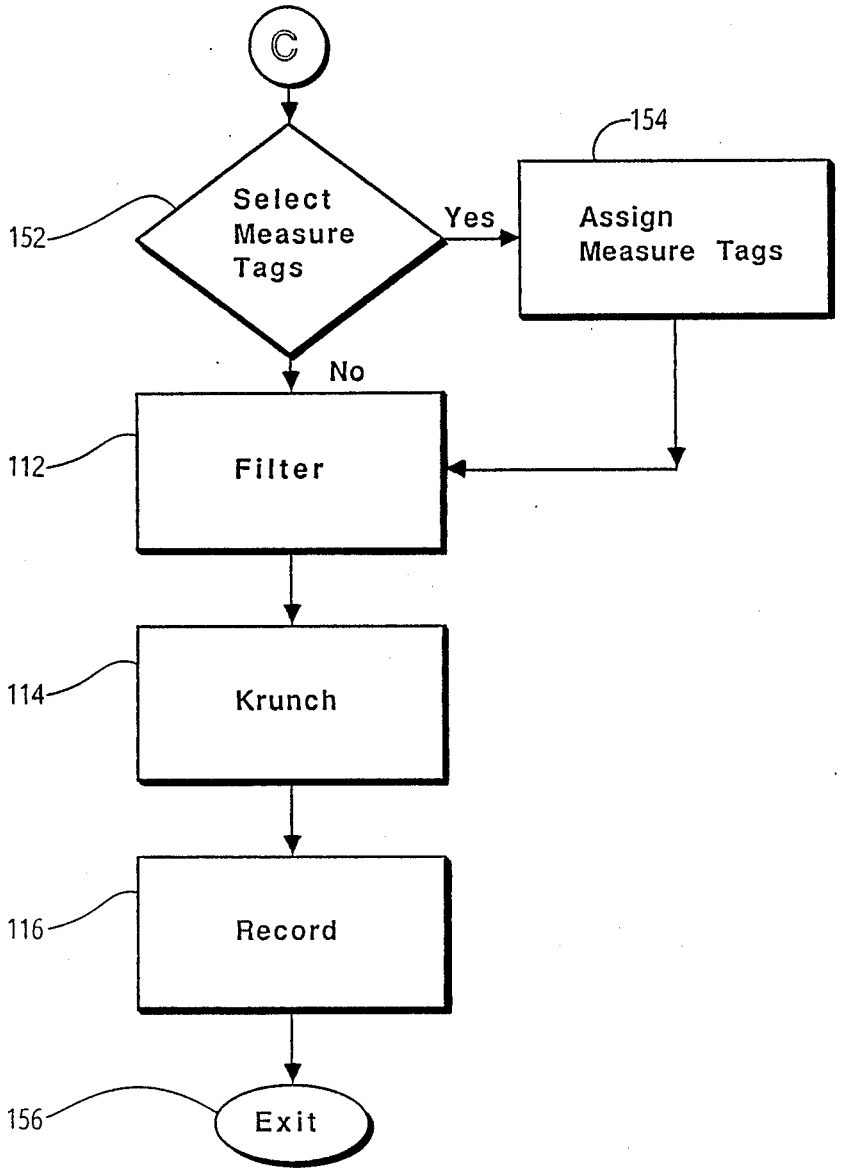

Referring now to FIGS. 9–11, flowcharts for the sequence of steps and flow of control among functional routines for the various methods of the present invention are shown. FIGS. 9*a*–9*b* show the flow of control for the In-Fix Transcription Method. At Start 100, the musician or composer has system 10 up and running in In-Fix Transcription Method and has, if desired, selected the particular stave system and instrument for which musical information will be transcribed, as well as the key signature the musical information will be entered in. At Assign Time Signature 102, the musician or composer may preassign the time signature for a given measure or set oof measures to be entered. More than one time signature may be designated if more than one measure will be entered. For example, the musician or composer may want to enter four measures at 4/4 time and then enter six measures at 3/4 time and would do so by designating the first four measures as 4/4 time and the remaining measures as 3/4 time. At Assign Beat Unit Key 104, the key, pedal, or note that will be used to enter the beat units is defined. System 10 will request the musician or composer to strike the key or pedal to be defined as the beat unit. As seen in FIGS. 8*a* and 8*b*, this key will be represented as a unique MIDI data value and system 10 will interpret the selected data value as designating a beat unit each time it encounters that data value in the music data input stream. Select Beat Unit Division 106 and Assign Beat Unit Division 107 allow the musician or composer to inform system 10 what note value, i.e. quarter note, eighth note, etc., the beat unit should indicate. The beat unit division may be identical to the base number of the time signature, for instance a quarter note for a 4/4 time signature. More typically, the beat unit division will be some fraction of the base number of the time signature. The default setting is to treat the beat unit as a quarter note and to set the beat unit division at an eighth note. In this case, the musician would enter the beat unit values by tapping "one-and-two-and-three-and . . . " on the designated beat unit key, soft pedal 22 for example. Now, the musician or composer is ready to enter the music data comprised of both the melodic information and the rhythmic information. Capture Measure 108 will accumulate a stream of MIDI data until a measures worth of beat units are detected. Once this condition occurs, Capture Measure 108 will assign relative note durations to all of the melodic information for that measure using the Resolution Community routine described in connection with FIGS. 12*a*–12*d*. When relative note durations have been assigned, the measures worth of music data is then passed on to Transfer 110, Filter 112, Krunch 114, and Record 116 to transcribe the music data into graphical data that may ultimately be displayed as musical notation. This process is described in more detail in connection with the description of the Transcription Community shown in FIG. 14. When the musician or composer has completed entry of the music data, Done 118, control is returned to a supervisory routine via Exit 120.

FIGS. 10*a*–10*d* show the flow of control for the Post-Fix Transcription Method. At Start 130, the musician or composer has system 10 up and running in Post-Fix Transcription Method and has, if desired, selected the particular stave system and instrument for which musical information will be transcribed, as well as the key signature the musical information will be entered in. At Select Time Signature 132, the musician or composer may choose to input the time signature using Assign Time Signature 102. However, as discussed below, the musician or composer may wish to enter the melodic and rhythmic information without choosing a time signature and let system 10 determine the proper time signature based either on the accent beats or the measure tags. Capture Melodic Information 134 simply stores all of the melodic information entered in the form of music data. When the musician or composer is done entering the melodic information. Done 136, Time Tagging is performed. Time Tagging is accomplished by setting the beat unit valve, i.e. quarter note, Assign Beat Unit 138, choosing the beat unit division to be tapped out, i.e. an eighth note, Assign Beat Unit Division 140, and then choosing what key on computer keyboard 24 or on electronic keyboard 12 will be used to tap out the beat units, Assign Beat Unit Key 142. Playback Music Data 144 and Assign Time Tags 146 work in conjunction with the Resolution Community to determine the relative note duration of the melodic information contained in the music data captured by Capture Melodic Information 134. playback Music Data 144 may output the music data back through electronic keyboard 12, through an internal speaker on microcomputer 16, or may simply output the music data visually on computer screen 18, or may output the music data using a combination of methods. The idea is to let the musician or composer see and/or hear the melodic information and then using Assign Time Tags 146, set where the beat units should be. Afte Time Tagging, the musician or composer may also insert accent values by Select Accent Beat 148 using Playback Music Data 144 and Assign Accent Beats 150. At Select Measure Tags 152, the musician or composer is ready either to have the system divide the music data into measures or to enter individual measure tags using Assign Measure Tags 154. if no initial time signature was selected, time signatures for each measure are calculated on the basis of all of the rhythmic information entered. With all of the music data now resolved into relative note durations values, Filter 112, Krunch 114, and Record 116 are called to perform the transcription and control is returned back to the supervisory program via Exit 156.

Figure 11A:
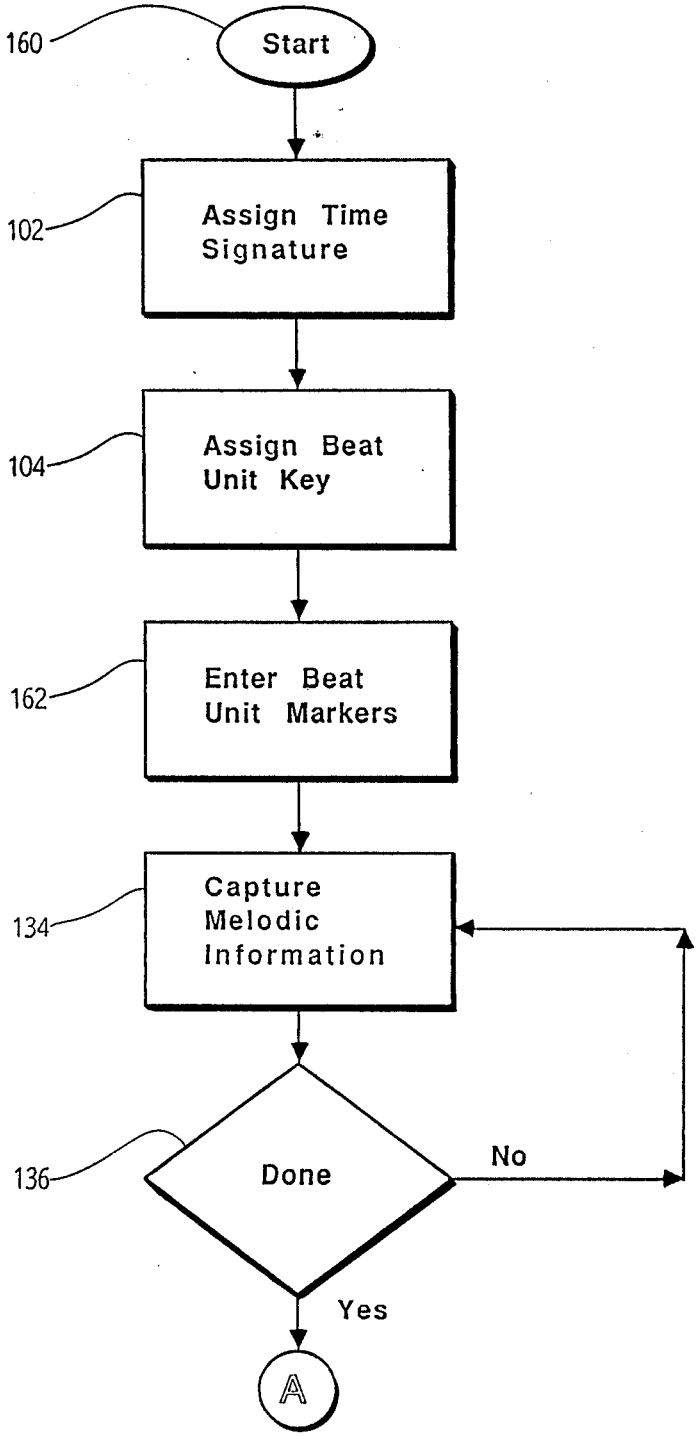
FIGS. 11*a*–11*b* are flowchart diagram of the transcription method of the present invention when rhythmic information is approximated by the system, the Companding Transcription Method.
Figure 11B:
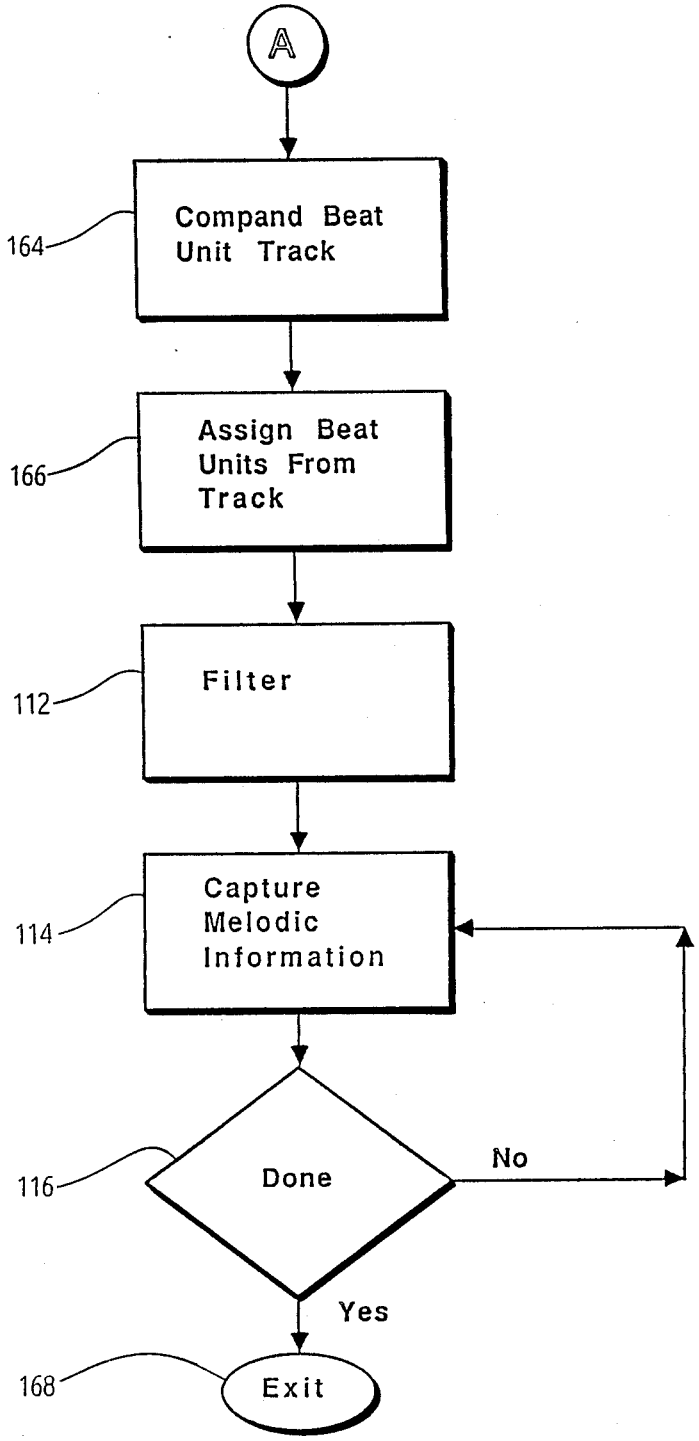
Figure 12A:
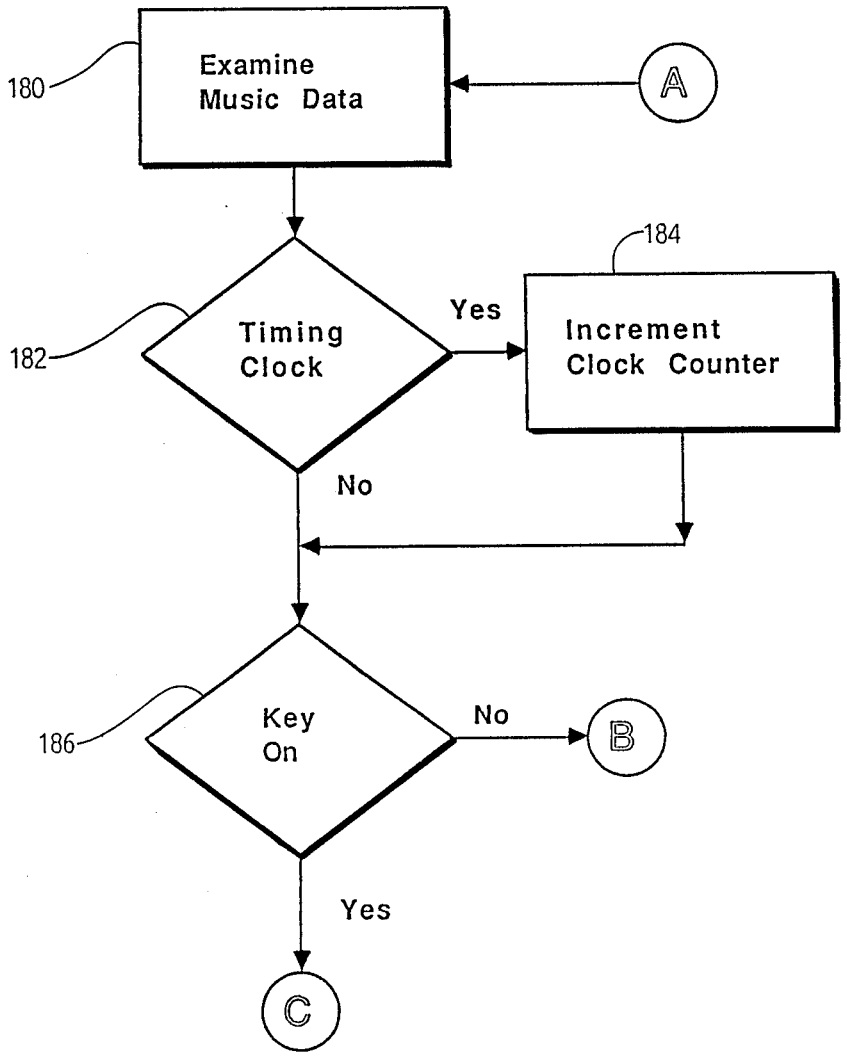
FIGS. 12*a*–12*d* are a flowchart diagram of the Resolution Community, the software module responsible for receiving the music data and resolving relative note durations based on the rhythmic and melodic information.
Figure 12B:
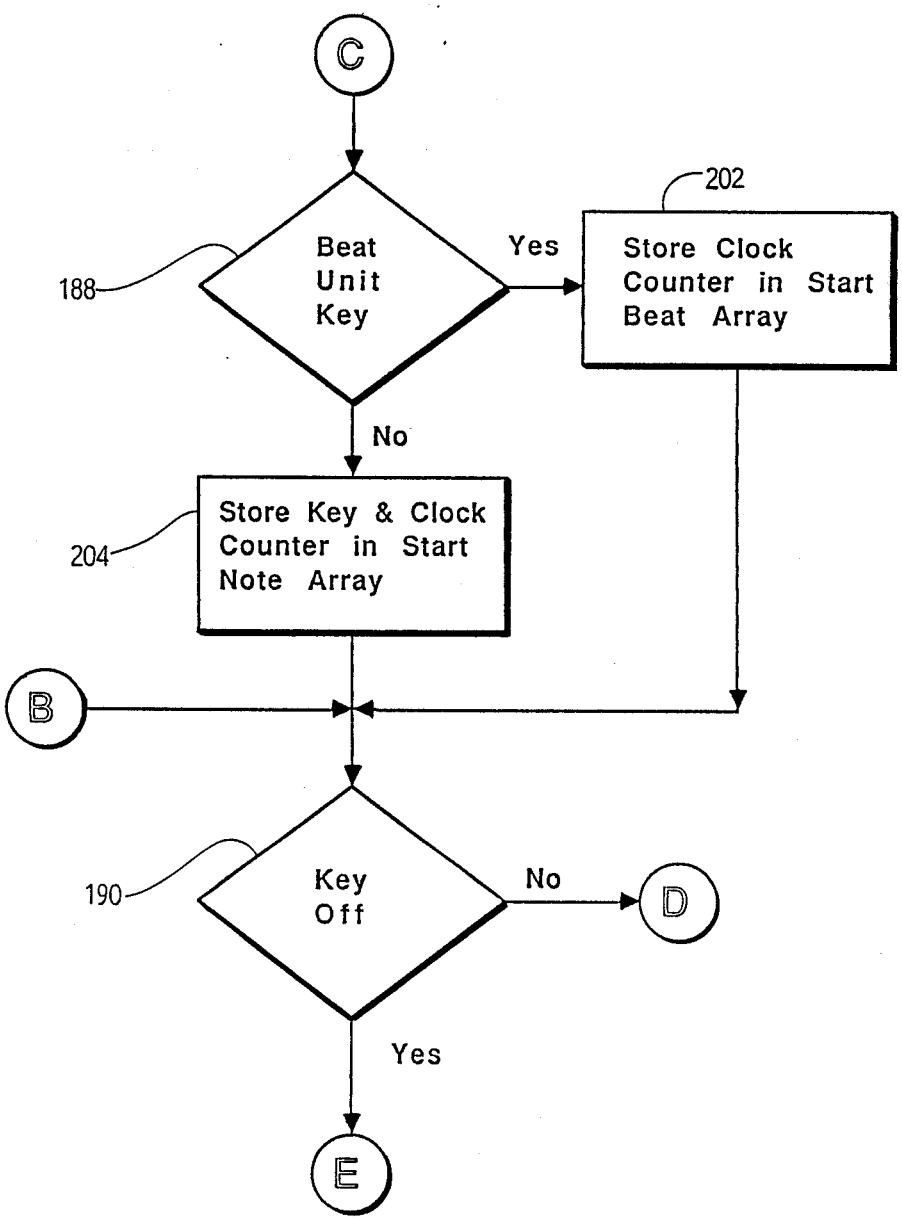
Figure 12C:
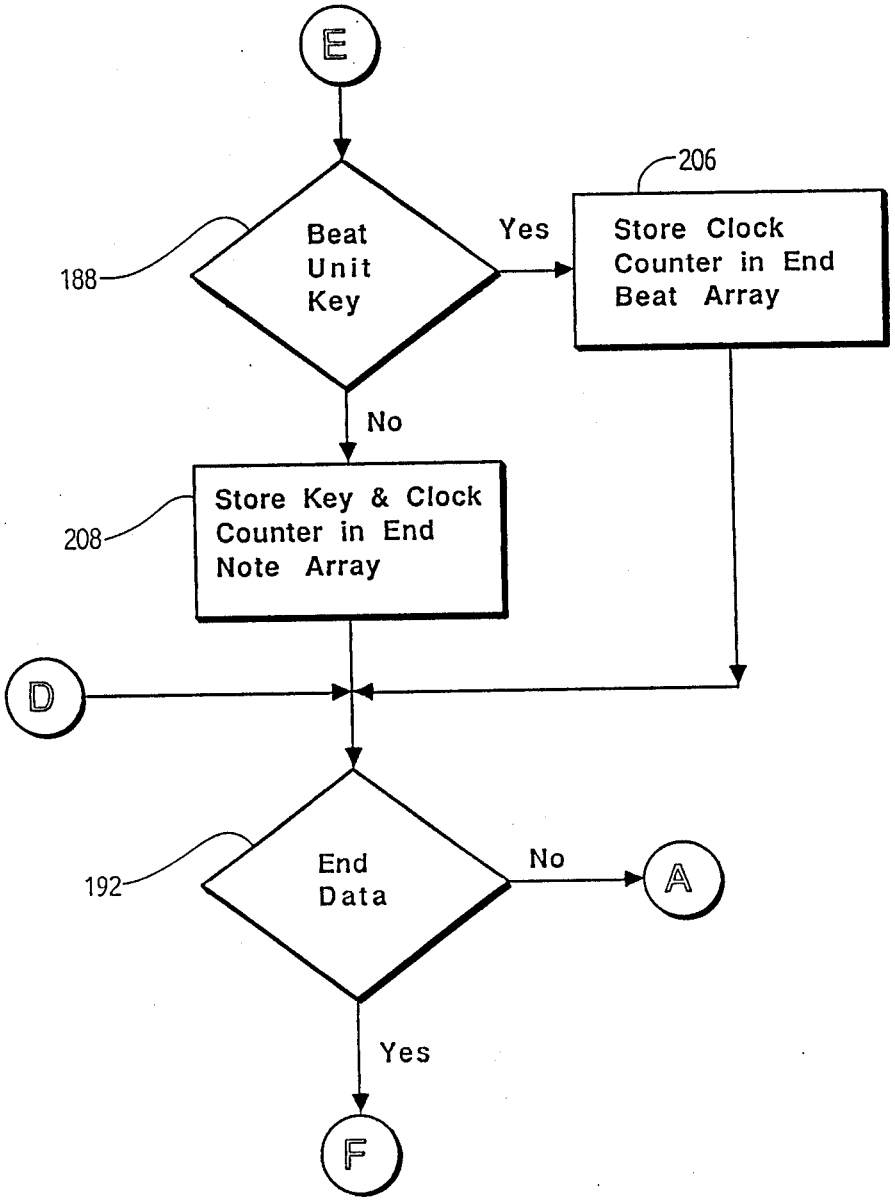
Figure 12D:
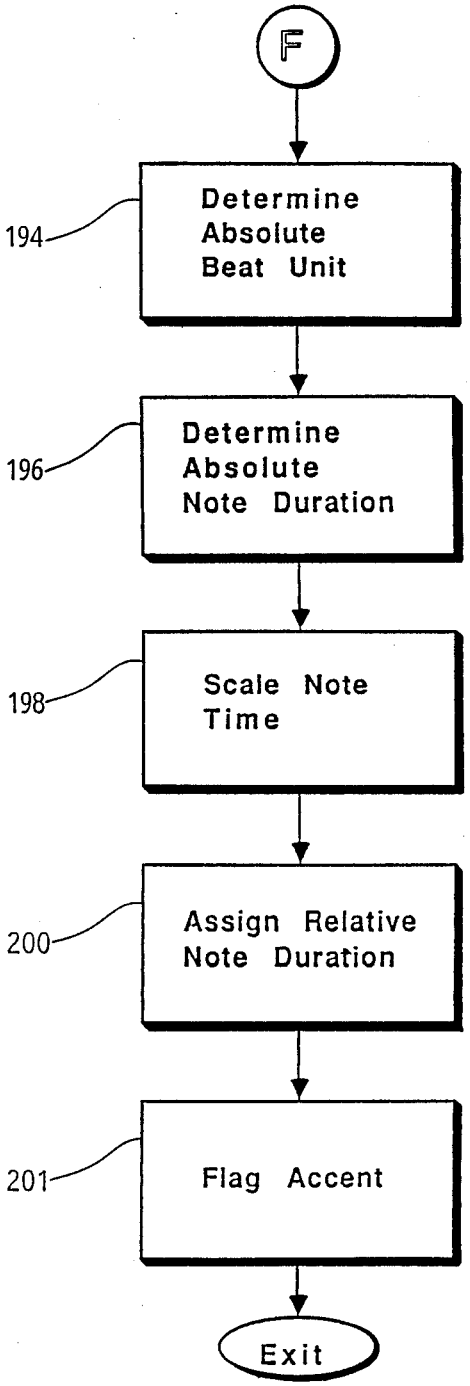

FIGS. 11*a*–11*b* show the flow of contrl for the Companding Transcription Method. At Start 160, the musician or composer has system 10 up and running in Companding Transcription Method and has, if desired, selected the particular stave system and instrument for which musical information will be transcribed, as well as the key signature the musical information will be entered in. The musician or composer assigns a time signature or time signatures at Assign Time Signature 102. As in the Post-Fix Transcription Method, a beat unit key is designated by Assign Beat Unit Key 104. It should be noted that system 10 may use the first key entered as a default beat unit key if no key is designated. The musician or composer then enters the length of the starting beat unit by striking the beat unit key twice with the length of time between determined to be the starting beat unit value, Enter Beat Unit Markers 162. The melodic information is stored by Capture Melodic Information 134 until Done 136. At Compand Beat Unit Track 164, a series of algorithms are used to determine a best fit beat unit "track" to be laid down over the melodic information just entered. This may be accomplished by any number of mathematical approximations. In a preferred embodiment, the present invention uses a companding technique of estimating a little longer or little shorter duration for the next beat unit if the beat unit does not occur when expected and then doing a successive approximation until a beat unit is actually detected in the music data. After the beat units have been automatically inserted into the music data by Assign Beat Units From Track 166, the music data is passed along to Filter 112, Krunch 114, and Record 116 to perform the transcription and then control is returned back to the supervisory program via Exit 168.

Referring now to FIGS. 12*a*–12*d*, a flowchart for the Resolution Community software module is shown. In the preferred embodiment of the invention, the Resolution Community works with MIDI data of the type shown in FIG. 8*b*. It should be recognized that the principles utilized by the Resolution Community would also be applicable to resolving other types of music data as well. Once the music data has been received, including both melodic and rhythmic components, regardless of which transcription method was used to generate the rhythmic component of the music data, the Resolution Community begins by examining the raw data, Examining Music Data 180. In looking at the MIDI music data, the routine will look for both Timing Clock Bytes 80 and Key On Bytes 82 and Key Off Bytes 84. Timing Clock 182 checks the MIDI music data for a Timing Clock Byte 80. If one is found, Increment Clock Counter 184 is performed incrmenting Clock Counter by one. In the preferred embodiment, the resolution of Clock Counter is 1/1,000ths of a second. While this resolution is used in the preferred embodiment, it is anticipated that finer time resolutions will be used as MIDI input devices and the MIDI standard become more refined. Key On 186 checks the MIDI music data for a Key On Byte 82. If one is found, Beat Unit Key 188 checks the Assign Beat Unit Key 142 value to see if it is a beat unit. If so, the value of Clock Counter is stored in Store Clock Counter in Start Beat Unit Array 202. If not, the value of Clock Counter and the pitch of the key are stored in Store Key & Clock Counter in Start Note Array 204. Key Off 190 checks the MIDI music data for a Key Off Byte 84. If one is found, Beat Unit Key 188 checks the Assign Beat Unit Key 142 value to see if it is a beat unit. If so, the value of Clock Counter is stored in Store Clock Counter in End Beat Unit Array 206, If not, the value of Clock Counter and the pitch of the key are stored in Store Key & Clock Counter in End Note Array 208. End Data 192 performs this loop until either the end of a measures worth of MIDI music data or until the end of all of the MIDI music data that was entered. Determine Absolute Beat Unit 194 compares Start Beat Unit Array 202 and End Beat Unit Array 206 to determine an absolute time for each beat unit. Determine Absolute Note Duration 196 compares Start Note Array 204 and End Note Array 208 to determine an absolute time for each note. Scale Note Time 198 computes a ratio between the absolute beat time and the absolute note time to generate a relative note time in relation to the beat unit which Assign Relative Note Duration 200 uses to assigns note values, i,e. quarter note, eighth note, etc. to the individual notes. Flag Accent 201 will flag those notes that should receive accent or which occurred on or within a predefined time span of the occurrence of a beat unit.

Figure 13:
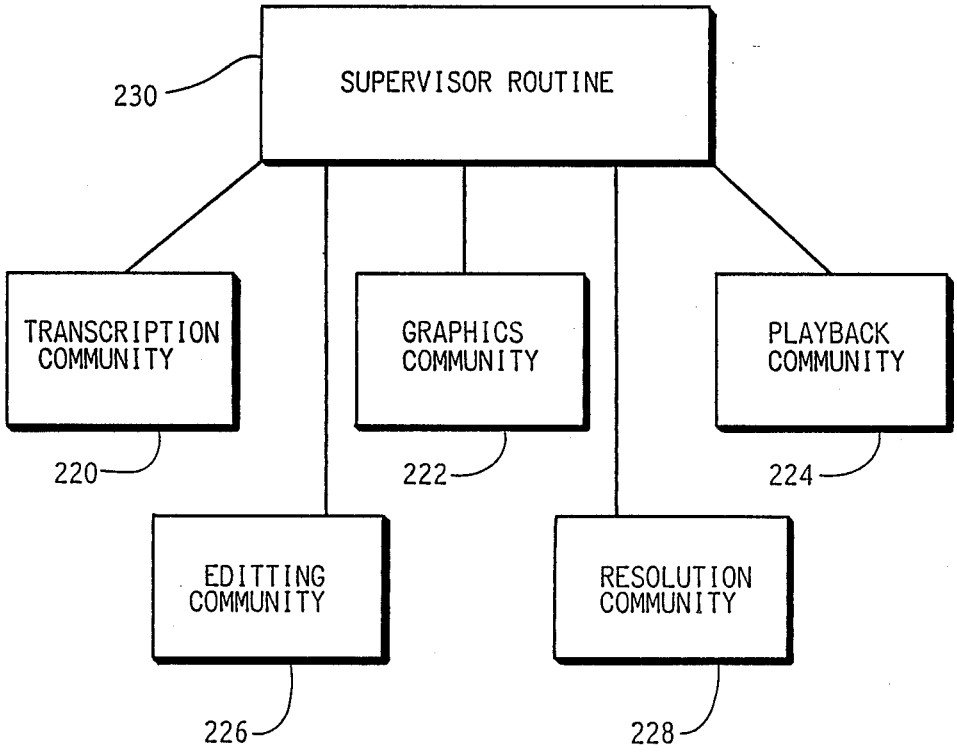
FIG. 13 is a block diagram of some of the communities or software routines that are used in the preferred embodiment of the invention.

Referring now to FIG. 13, a block diagram of some of the important communities or routines that comprises the preferred embodiment of the software used to accomplish the present invention is shown. While only the software communities or routines used to perform the entry and transcription of the music data are described in this invention, it will be apparent that other software routines may be used in conjunction with the present invention to accomplish the editing display, playback, and printing of the music data. FIG. 13 shows one embodiment of a Transcription Community 220, a Graphics Community 222, a Playback Community 224, an Editing Community 226, Resolution Community 228, and a Supervisor Routine 230. Transcription Community 220 is responsible for conversion of music data input from Resolution Community 228 into usable data for the rest of the communities in the form of Graphic File data records. The Graphics Community 222 is responsible for assembling a visual score for the musical data. Using the instruction found in Graphic File data records, the Graphics Community 222 selects execution paths that will create the visual score. The Playback Community 224 is responsible for assembling a performance of Graphic File data records. Using instructions found in Graphic File data records, the Playback Community 224 creates a playback list and calls a routine to output that information to a playback channel connected to an internal or external speaker or microcomputer 16 or via MIDI interface 14 to any MIDI device, for example electronic keyboard 12. The Editing Community 226 is responsible for manipulating Graphic File data records. After the manipulation is complete, Supervisor Routine 230 could call Graphics Community 222 to update the visual display of the music or Playback Community 224 to perform the changes.

Figure 14:
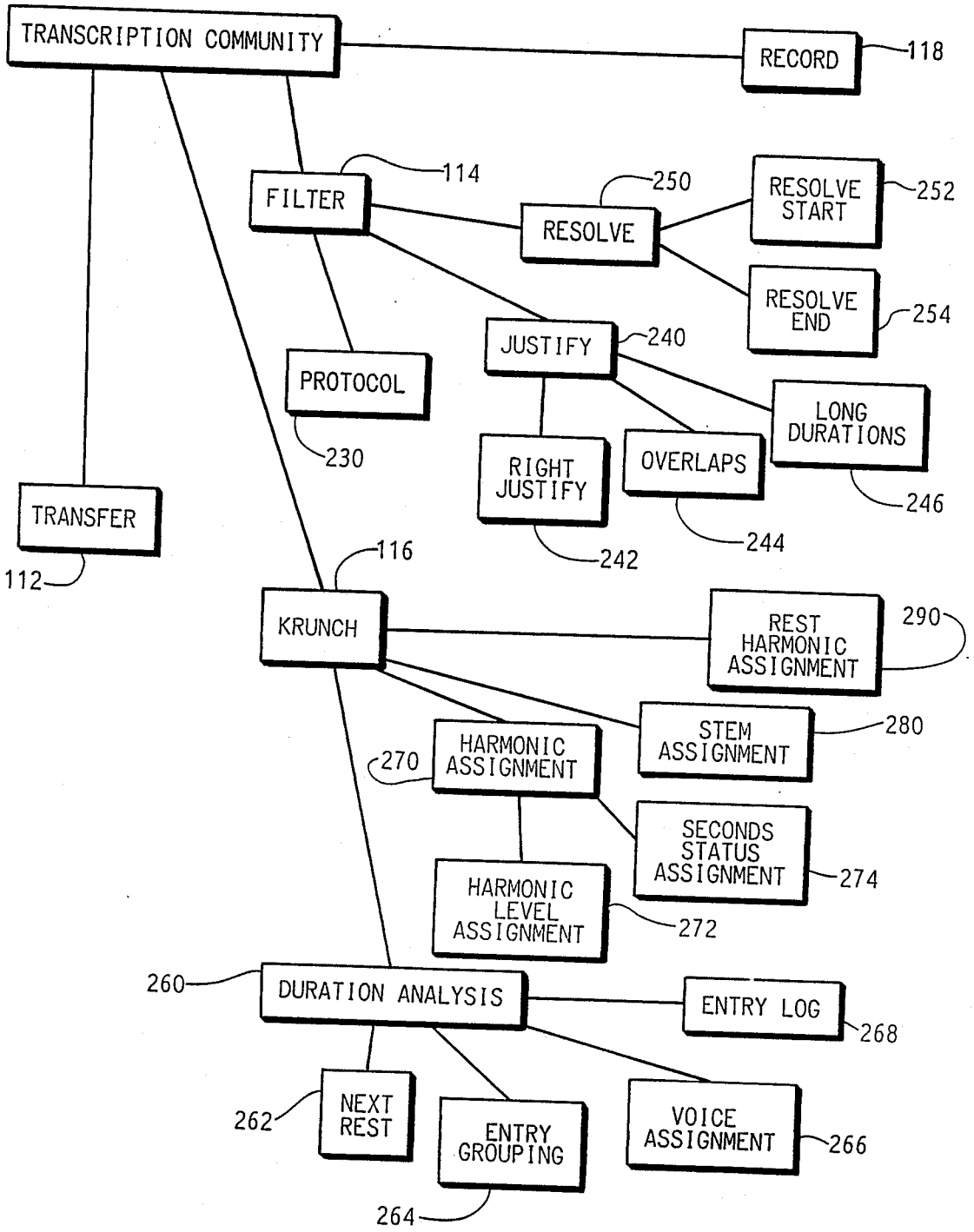
FIG. 14 is a block diagram of the Transcription Community, the software modules responsible for handling the transcription of melodic and rhythmic information.

As seen in FIG. 14, Transcription Community 220 breaks down into four districts: Transfer 112, Filter 114, Krunch 116, and Record 118. Transfer District 112 is responsible for packing the structure of an internal intermediate data record with a measure's worth of information. Filter District 114 is responsible for arranging the intermediate data records for processing by Krunch District 116. In insures that the notes are in the proper format and performs any necessary data manipulation including quantization. Krunch District 116 converts the sanitized internal data records in Graphic File data records. In the process it will perform duration analysis, harmonic analysis, stem assignment and harmonic rest assignment. Record District 118 places the Graphic File data record into mass storage, either internal RAM storage or external disk storage depending upon the current instructions and settings of Supervisor Routine 230.

Both Filter District 114 and Krunch District 116 are further divided into townships relating to particular functions that these two programs do. Filter District 114 breaks into three townships: Protocol Township 230, Justify Township 240, and Resolve Township 250. Protocol Township 230 insures that the music data is in the correct protocol. It is called at the beginning and end of Filter District 114. Justify Township 240 breaks down into three blocks: Right Justify 242, Overlaps 244, and Long Durations 246. Justify Township 240 justifies the left and right edges or note groupings. It also checks for quick successions of notes that have small durations and small overlaps and eliminates these overlaps. Resolve Township 250 breaks down into two blocks: Resolve Start 252 and Resolve End 254. Resolve Township 250 quantizes the music data according to the beat unit division value set by the musician or composer during Assign Beat Unit Division 107. Krunch District 116 breaks into four townships: Duration Analysis Township 260, Harmonic Analysis Township 270, Stem Assignment Township 280, and Rest Harmonic Assignment Township 290. Duration Analysis Township 260 sweeps the music data and compiles entries which may be either notes or rests. It assigns individual notes in the music data primary voice or secondary voice status and generates and interleaves any neccesary rests. Duration Analysis Township 260 breaks into four blocks: Next Rest Block 262, Entry Grouping Block 264, Voice Assignment Block 266, and Entry Log Block 268. Harmonic Assignment Township 270 takes the new entries compiled by Duration Analysis Township 260 and the current key signature as entered by the musician or composer and assigns harmonic content to the notes. Harmonic Assignment Township 270 breaks into two blocks: Harmonic Level Assignment Block 272 and Seconds Status Assignment 274. Stem Assignment Townsip 280 sweeps the entries and assigns stem directions. Rest Harmonic Assignment Township 290 sweeps the entries and assigns harmonic content to the rests.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. A music notation system for transcribing music, comprising:

instrument means for selectively entering both melodic and rhythmic information associated with said music simultaneously, said melodic information including a plurality of notes and said rhythmic information including a plurality of beat units corresponding to said notes;

interface means operably connected to said instrument means for converting said melodic and rhythmic information into music data and transmitting said music data; and programmable data proccessing means operably connected to said interface means for receiving said music data and transcribing said music data including:

means for dynamically determining an individual beat unit duration for each of said beat units in response to the selective entering of said rhythmic information:

means for dynamically determining an individual absolute note duration of each of said notes in response to the selective entering of said melodic information:

means for automatically assigning a relative note duration to each of said notes based upon a comparison of the relationship of said absolute note duration to said beat unit durations occuring during the same time period of said note; and means for generating a graphical musical notation for said notes based upon said relative note durations.

2. The music notation system of claim 1 wherein said music data is represented as a key on a key off indication for each note played on said instrument means.

3. The music notation system of claim 2 wherein said instrument means further comprises a rhythm indicator key for entering said rhythmic information.

4. The music notation system of claim 3 further comprising a display terminal and a printer operably connected to said programmable data processing means and wherein said means for generating graphical musical notation comprises software means for generating both graphical musical notation to be displayed on said display terminal and graphical musical notation to be printed by said printer.

5. A system for notating musical information for a musical composition, comprising:

means for entering melodic information for said musical composition, said melodic information comprising:

a plurality of absolute note durations having a note-on indication and a note-off indication; and a tone value for each of said absolute note durations;

means for entering rhythmic information for said musical composition, comprising:

means for designing a dynamically changing beat unit interval;

means for assigning a relative beat duration value to said beat unit interval; and means for entering one or more of said beat unit intervals associated with said melodic information; and processing means for receiving said melodic information and said rhythmic information and for automatically assigning relative note duration values to said absolute durations in response to the entering of said melodicand said rhythmic information based on a comparison of the relationship between said beat unit intervals and said absolute note drations.

6. The system for notating musical information of claim 5 wherein said means for entering said beat unit interval comprises a key designated by said means for designating a beat unit interval that is tapped on and tapped off to indicate the entry of a single beat unit interval.

7. The system for notating musical information of claim 6 wherein said key is repetitively tapped on and tapped off simultaneously with the entering of said melodic information.

8. The system for notating musical information of claim 6 wherein said key is repetitively tapped on and tapped off during a subsequent playback of said melodic information.

9. The system for notating musical information of claim 6 wherein said key is tapped on and tapped off at least once to create a starting beat unit interval and wherein said means for entering rhythmic information further comprises processing means for approximating the remaining beat unit intervals associated wth said melodic information based upon said starting beat unit interval.

10. The system for notating musical information of claim 9 wherein said processing means uses a companded approximation to sequentially generate a next beat unit interval based upon a compressed or expanded version of a previous beat unit interval.

11. The system for notating musical iinformation of claim 6 wherein said key may be tapped on and tapped off prior to, simultaneous with, or after the entering of said melodic information.

12. A resolution system for assigning relative note duration values to music data being transcribed, said music data comprising a plurality of encoded key-on and key-off signals representing notes, a plurality of encoded key-on and key-off signals representing dynamically changing beat units associated with said notes and a plurality of associated timing clock signals, comprising:

data processing means for receiving said music data;

clock extracting means for generating a timing count by counting said timing clock signals in said music data;

key-on detection means for detecting each of said key-on signals and storing a first timing count corresponding to the time said key-on signal representing a note was detected;

key-off detection means for detecting each of said key-off signals and storing a second timing count corresponding to the time said key-off signal for said note was detected such that said first and second timing counts define an absolute note duration;

beat unit detection means for comparing each of said key-on and key-off signals with a preselected beat unit key representing a duration of one of said dynamically changing beat units and having a preselected absolute beat unit note value such that said duration for said beat unit key defines an absolute beat unit duration for the time period between successive key-on signals and key-off signals for said beat unit key; and scaling means for assigning a relative note value to each of said absolute note durations based on a comparison of the relationship between said absolute beat unit duration and said absolute note duration in comparison to said preselected beat unit note value.

13. A resolution system for assigning relative note duration values to music data to be transcribed, said music data comprising a pluality of encoded key-on and key-off signals representing notes, a plurality of encoded key-on and key-off signals representing dyynamically changing beat units associated with said notes and a plurality of associated timing clock signals, comprising:

data processing means for receiving said music data;

clock extracting means for generating a timing count by counting said timing clock signals in said music data;

key-on detection means for detecting each of said key-on signals and storing a first timing count corresponding to the time said key-on signal representing a note was detected;

key-off detection means for detecting each of said key-off signals and storing a second timing count corresponding to the time said key-off signal for said note was detected such that said first and second timing counts define an absolute note duration for said note;

beat unit generation means for defining an initial time interval as an absolute beat unit having a preselected beat unit duration value and for dynamically generating successive absolute beat units based on a companded approximation of the previous beat unit and the value of the next key-on signal corresponding to an expected value of the next beat unit; and scaling means for assigning a relative note duration value to each of said notes occurring during the time interval for said beat unit based on a comparison of the relation between said absolute note duration and said beat unit and in comparison to said preselected beat unit note duration value.

14. The resolution system of claim 13 wherein said beat unit generation means dynamically generates successive absolute beat units by detecting whether a key-on signal is present at said expected value of the timing count for the next absolute beat unit and incrementally increasing or decreasing said expected value of the timing count for the next absolute beat unit until a key-on signal is detected.

* * * * *